US011248856B2

(12) United States Patent
Kubo et al.

(10) Patent No.: US 11,248,856 B2
(45) Date of Patent: Feb. 15, 2022

(54) REFRIGERATION APPARATUS

(71) Applicant: DAIKIN INDUSTRIES, LTD., Osaka (JP)

(72) Inventors: Hiroharu Kubo, Osaka (JP); Hiroyuki Nakano, Osaka (JP); Yasuhiro Sasai, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 135 days.

(21) Appl. No.: 16/492,744

(22) PCT Filed: Feb. 14, 2018

(86) PCT No.: PCT/JP2018/004989
§ 371 (c)(1),
(2) Date: Sep. 10, 2019

(87) PCT Pub. No.: WO2018/163727
PCT Pub. Date: Sep. 13, 2018

(65) Prior Publication Data

US 2021/0148651 A1 May 20, 2021

(30) Foreign Application Priority Data

Mar. 10, 2017 (JP) ..... JP2017-046521

(51) Int. Cl.
*F28F 9/02* (2006.01)
*F24F 1/16* (2011.01)
(Continued)

(52) U.S. Cl.
CPC ..... *F28F 9/02* (2013.01); *F24F 1/16* (2013.01); *F28D 1/05391* (2013.01);
(Continued)

(58) Field of Classification Search
CPC ..... F28F 9/02; F28F 2215/12; F28F 2250/06; F28F 2275/04; F24F 1/16; F28D 1/05391; F28D 2021/0068
(Continued)

(56) References Cited

U.S. PATENT DOCUMENTS 5,236,042 A * 8/1993 Kado ..... F28F 9/001 165/149
5,325,914 A * 7/1994 Tanaka ..... F28F 9/002 165/149
(Continued)

FOREIGN PATENT DOCUMENTS

CN 104024745 A 9/2014
JP 2006226652 A 8/2006
(Continued)

OTHER PUBLICATIONS

International Search Report issued in corresponding International Application No. PCT/JP2018/004989 dated Apr. 10, 2018 (4 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

A refrigeration apparatus includes: a casing that includes first and second spaces; a heat exchanger housed in the casing and including a heat exchange portion and a header collecting tube. The heat exchange portion includes a plurality of heat transfer tubes through which a refrigerant flows, is disposed in the first space, and causes the refrigerant to exchange heat with an air flow. The header collecting tube is connected to the heat transfer tubes and disposed in the second space. The refrigeration apparatus also includes a wind shielding plate including a wind shielding
(Continued)

surface that shields the second space from the air flow, where the header collecting tube includes a header body portion that extends in a longitudinal direction of the header collecting tube, and the wind shielding plate is fixed to the header collecting tube and fixed to the casing or a component disposed in the casing.

8 Claims, 25 Drawing Sheets

(51) Int. Cl.
*F28D 1/053* (2006.01)
*F28D 21/00* (2006.01)

(52) U.S. Cl.
CPC .. *F28D 2021/0068* (2013.01); *F28F 2215/12* (2013.01); *F28F 2250/06* (2013.01); *F28F 2275/04* (2013.01)

(58) Field of Classification Search
USPC ..... 165/173
See application file for complete search history.

(56) References Cited

U.S. PATENT DOCUMENTS

| | | | | |
|---|---|---|---|---|
| 6,390,180 | B1 * | 5/2002 | Olsen | F28F 9/002 165/125 |
| 9,447,980 | B2 * | 9/2016 | Masui | F28F 1/128 |
| 10,317,147 | B2 * | 6/2019 | Mutou | F25B 39/04 |
| 10,451,363 | B2 * | 10/2019 | Eskew | F28D 1/0471 |
| 10,782,035 | B2 * | 9/2020 | Kaneda | F28D 1/053 |
| 2005/0086965 | A1 * | 4/2005 | Lalumiere | F28D 1/0477 62/277 |
| 2011/0073277 | A1 * | 3/2011 | Karl | F24F 13/30 165/67 |
| 2014/0131019 | A1 * | 5/2014 | Kagawa | F24F 1/22 165/121 |
| 2014/0374078 | A1 * | 12/2014 | Ono | F24F 13/222 165/173 |
| 2015/0007605 | A1 * | 1/2015 | Masui | F28F 13/00 62/508 |
| 2015/0041101 | A1 | 2/2015 | Hoshika et al. | |
| 2017/0219298 | A1 * | 8/2017 | Tsutsui | F28F 9/02 |
| 2017/0292741 | A1 * | 10/2017 | Inoue | F25B 13/00 |
| 2018/0209742 | A1 * | 7/2018 | Jiang | F28D 1/0477 |
| 2020/0011618 | A1 | 1/2020 | Oki et al. | |

FOREIGN PATENT DOCUMENTS

| | | | | |
|---|---|---|---|---|
| JP | 2006329464 | A | 12/2006 | |
| JP | 2010139088 | A | 6/2010 | |
| JP | 2012163290 | A | 8/2012 | |
| JP | 2013-137126 | A | 7/2013 | |
| JP | 2013-139930 | A | 7/2013 | |
| WO | 2011055598 | A1 | 5/2011 | |
| WO | WO-2016067947 | A1 * | 5/2016 | F28F 9/26 |
| WO | 2018190259 | A1 | 10/2018 | |

OTHER PUBLICATIONS

International Preliminary Report on Patentability issued in corresponding International Application No. PCT/JP2018/004989, dated Sep. 10, 2019, with translation (5 pages).

Notification of Transmittal of Translation of the International Preliminary Report on Patentability issued in corresponding International Application No. PCT/JP2018/004989, dated Sep. 19, 2019 (1 page).

Extended European Search Report issued in corresponding European Patent Application No. 18764010.7, dated Nov. 26, 2020 (7 pages).

* cited by examiner

REFRIGERATION APPARATUS

TECHNICAL FIELD

The present invention relates to a refrigeration apparatus.

BACKGROUND

Refrigeration apparatuses including heat exchangers that each cause a refrigerant and an air flow to exchange heat have been widely used. Such refrigeration apparatuses require various countermeasures to be considered to suppress a decrease in reliability in the following viewpoints. For example, in a case where a refrigeration apparatus is installed in a coastal region, a countermeasure against salt-air damage is required to be considered. Moreover, in a case where pipes and tools made of different kinds of metal (for example, copper and aluminum or an aluminum alloy) are connected to each other in a heat exchanger, a countermeasure against galvanic corrosion is required to be considered. Furthermore, in a case where an air flow is bypassed to a header collecting tube of a heat exchanger without properly passing through a heat transfer portion (a heat exchange portion) of the heat exchanger, performance may be degraded, and hence the bypass is required to be stopped. In these viewpoints, in an outdoor unit of an air conditioner disclosed in PTL 1 (Japanese Unexamined Patent Application Publication No. 2013-137126), a wind shielding plate that shields a header collecting tube or a space (a machine chamber), in which the header collecting tube is disposed, from the air flow is disposed.

Such a heat exchanger is typically disposed in a casing. The method of fixing the heat exchanger to the casing is typically fixing by screwing via a fixing member. In an outdoor unit of an air conditioner disclosed in PTL 2 (Japanese Unexamined Patent Application Publication No. 2013-139930), a heat exchanger is screwed and fixed to a side plate of a casing via a bracket brazed to a header collecting tube.

In a refrigeration apparatus including such a heat exchanger, when the technology in PTL 1 (the wind shielding plate that shields the header collecting tube side) is employed and the technology in PTL 2 (fixing by screwing to the casing via the bracket) is employed to suppress a decrease in reliability, the cost increases due to an increase in the number of parts.

PATENT LITERATURE

PTL 1: Japanese Unexamined Patent Application Publication No. 2013-137126

PTL 2: Japanese Unexamined Patent Application Publication No. 2013-139930

SUMMARY

Accordingly, one or more embodiments of the present invention provide a refrigeration apparatus that suppresses an increase in cost and that suppresses a decrease in reliability.

A refrigeration apparatus according to one or more embodiments of the present invention includes a casing, a heat exchanger, and a wind shielding plate. The casing forms therein a first space and a second space. The heat exchanger is housed in the casing. The heat exchanger includes a plurality of heat transfer tubes. A refrigerant flows through the heat transfer tubes. The heat exchanger includes a heat exchange portion and a header collecting tube. The heat exchange portion is disposed in the first space. The heat exchange portion causes the refrigerant and an air flow to exchange heat. The header collecting tube is connected to the heat transfer tubes and disposed in the second space. The wind shielding plate includes a wind shielding surface. The wind shielding surface shields the second space from the air flow. The header collecting tube includes a header body portion. The header body portion extends in a longitudinal direction. The wind shielding plate is fixed to the header collecting tube. The wind shielding plate is fixed to the casing or another member disposed in the casing.

With the refrigeration apparatus according to one or more embodiments of the present invention, the wind shielding plate includes the wind shielding surface that shields the second space from the air flow. Thus, the air flow does not flow into the second space. Consequently, salt-air damage and galvanic corrosion are suppressed at the header collecting tube disposed in the second space and its peripheral portion. In addition, a decrease in the volume of air is suppressed in the first space in which the heat exchange portion is disposed. Relating to this, a decrease in performance of the refrigeration apparatus is suppressed.

Moreover, with the refrigeration apparatus according to one or more embodiments of the present invention, the wind shielding plate is fixed to the header collecting tube of the heat exchanger and fixed to the casing or another member disposed in the casing. Thus, the heat exchanger can be fixed to the casing or the other member disposed in the casing via the wind shielding plate. That is, the wind shielding plate can function as a fixing member for fixing the heat exchanger (that is, the wind shielding plate can have both a function as a shielding member and a function as the fixing member). Consequently, the shielding member and the fixing member which have been configured as separate members in related art can be integrated, and the number of parts can be decreased.

Thus, an increase in cost is suppressed, and a decrease in reliability is suppressed.

According to one or more embodiments of the present invention, the header collecting tube forms therein a header inner space. The refrigerant comes into and out from the header inner space. The header body portion has an opening in a cross section in a transverse direction. The wind shielding plate is joined to the header body portion to cover the opening. The wind shielding plate forms the header inner space together with the header body portion.

According to one or more embodiments of the present invention, the header body portion of the header collecting tube has the opening in the cross section in the transverse direction, and the wind shielding plate is joined to the header body portion to cover the opening, and forms the header inner space together with the header body portion. Thus, the components of the header collecting tube can be also used as a wind shielding plate and a fixing member. Accordingly, the number of parts is further decreased, and an increase in cost is further suppressed.

According to one or more embodiments of the present invention, the wind shielding surface extends in the longitudinal direction of the header body portion. The wind shielding surface shields an area from one end to the other end of the header body portion in the longitudinal direction, from the air flow. Thus, the header body portion is shielded from the air flow. Consequently, a decrease in reliability because the header body portion is corroded by galvanic corrosion or salt-air damage is prevented from occurring with high precision.

According to one or more embodiments of the present invention, one of the wind shielding plate and the header body portion has a protrusion. The other one of the wind shielding plate and the header body portion has an engagement hole. The protrusion is engaged with the engagement hole in a state in which the wind shielding plate and the header body plate are fixed. Thus, the wind shielding plate is easily fixed to the header body portion. That is, efficiency of assembly is increased when the header collecting tube is assembled.

According to one or more embodiments of the present invention, the wind shielding plate is joined by brazing to the header body portion. Thus, the wind shielding plate is rigidly fixed to the header body portion. Accordingly, the rigidity of the header collecting tube increases, and a decrease in reliability is further suppressed.

According to one or more embodiments of the present invention, a portion of the wind shielding plate that comes into contact with the header collecting tube is made of a brazing alloy. Thus, efficiency of brazing is increased when the wind shielding plate and the header collecting tube are joined by brazing.

According to one or more embodiments of the present invention, each of the heat transfer tubes is a flat tube. The wind shielding plate has an insertion hole. Each of the heat transfer tubes is inserted into the insertion hole. Thus, the wind shielding plate can function as a tube plate for supporting the flat tube, thereby further promoting a decrease in the number of parts. Thus, an increase in cost is suppressed.

According to one or more embodiments of the present invention, an edge portion of the insertion hole of the wind shielding plate is made of a brazing alloy. Thus, efficiency of brazing is increased when the wind shielding plate and the heat transfer tubes are joined by brazing.

According to one or more embodiments of the present invention, salt-air damage and galvanic corrosion are suppressed at the header collecting tube disposed in the second space and its peripheral portion. In addition, a decrease in the volume of air is suppressed in the first space in which the heat exchange portion is disposed. Relating to this, a decrease in performance of the refrigeration apparatus is suppressed. Moreover, the wind shielding plate can function as a fixing member for fixing the heat exchanger (that is, the wind shielding plate can have both a function as a shielding member and a function as the fixing member). Consequently, the shielding member and the fixing member which have been configured as separate members in related art can be integrated, and the number of parts can be decreased. Thus, an increase in cost is suppressed, and a decrease in reliability is suppressed.

According to one or more embodiments of the present invention, the components of the header collecting tube can be also used as a wind shielding plate and a fixing member. Accordingly, the number of parts is further decreased, and an increase in cost is further suppressed.

According to one or more embodiments of the present invention, a decrease in reliability because the header body portion is corroded by galvanic corrosion or salt-air damage is prevented from occurring with high precision.

According to one or more embodiments of the present invention, efficiency of assembly increases.

According to one or more embodiments of the present invention, the rigidity of the header collecting tube increases, and a decrease in reliability is further suppressed.

According to one or more embodiments of the present invention, efficiency of brazing is increased when the wind shielding plate and the header collecting tube are joined by brazing.

According to one or more embodiments of the present invention, an increase in cost is further suppressed.

According to one or more embodiments of the present invention, efficiency of brazing is increased when the wind shielding plate and the heat transfer tubes are joined by brazing.

DETAILED DESCRIPTION

An air conditioner 100 including an outdoor unit 10 (a refrigeration apparatus) according to one or more embodiments of the present invention is described below with reference to the drawings. The following embodiments are only examples of the present invention. The embodiments do not limit the technical scope of the invention, and may be properly modified within a range not departing from the gist of the invention.

In the following description, a direction, such as up, down, left, right, front surface (front), or rear surface (back), represents a direction indicated in FIGS. 2 to 4, 6, and 11 to 24. The left and right directions may be properly inverted and/or the front and rear directions may be properly inverted. In the following description, unless otherwise noted, "a gas refrigerant" includes a gas refrigerant in a saturated state or a superheated state and a refrigerant in a gas-liquid two-phase state; and "a liquid refrigerant" includes a liquid refrigerant in a saturated state or a sub-cooled state and a refrigerant in a gas-liquid two-phase state.

(1) Air Conditioner 100

Figure 1:
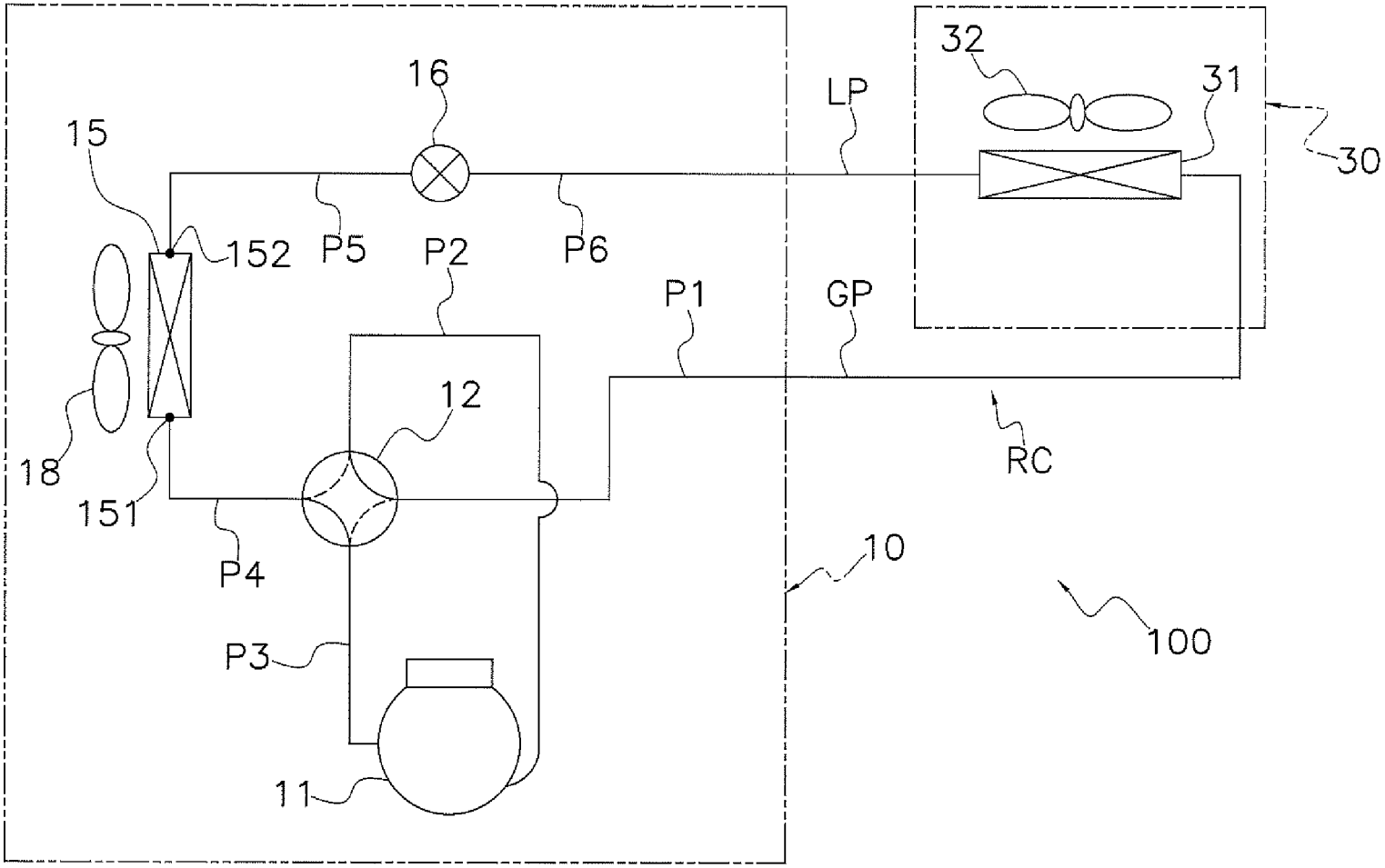
FIG. 1 is a schematic configuration diagram of an air conditioner in accordance with one or more embodiments.

FIG. 1 is a schematic configuration diagram of an air conditioner 100 according to one or more embodiments of the present invention. The air conditioner 100 is an apparatus that performs cooling operation (forward cycle operation) or heating operation (reverse cycle operation) to provide air conditioning in a target space. The air conditioner 100 mainly includes an outdoor unit 10 serving as a heat source unit, and an indoor unit 30 serving as a utilization unit. In the air conditioner 100, the outdoor unit 10 is connected to the indoor unit 30 by a gas-side connection pipe GP and a liquid-side connection pipe LP, and hence a refrigerant circuit RC is constituted.

The air conditioner 100 performs a vapor compression refrigeration cycle in which the refrigerant enclosed in the refrigerant circuit RC is compressed, cooled or condensed, decompressed, heated or evaporated, and then compressed again. Although the refrigerant enclosed in the refrigerant circuit RC is not limited, a hydrofluorocarbon (HFC) refrigerant, such as R32 or R410A, is enclosed in the refrigerant circuit RC.

(1-1) Outdoor Unit 10

The outdoor unit 10 mainly includes, as devices that constitute the refrigerant circuit RC, a compressor 11, a four-way switching valve 12, an outdoor heat exchanger 15, an expansion valve 16, and a plurality of refrigerant pipes (a first pipe P1 to a sixth pipe P6). In addition, the outdoor unit 10 includes an outdoor fan 18 that generates an air flow. The air flow passes through the outdoor heat exchanger 15 and exchanges heat with the refrigerant in the outdoor heat exchanger 15.

The compressor 11 is a device that sucks the low-pressure gas refrigerant, compresses the refrigerant, and then discharges the refrigerant as the high-pressure gas refrigerant. The compressor 11 has a closed structure including a built-in compressor motor (not illustrated) serving as a drive source. The compressor 11 includes a rotary or scroll compression element (not illustrated). The compressor 11 in operation is subjected to inverter control, and hence the number of rotations of the compressor 11 is adjusted in accordance with the circumstance. That is, the capacity of the compressor 11 is variable.

The four-way switching valve 12 is a switching valve for switching the flow direction of the refrigerant in the refrigerant circuit RC. The state of the four-way switching valve 12 is controlled in accordance with the circumstance. The four-way switching valve 12 in cooling operation is controlled to be in a first state (see solid lines of the four-way switching valve 12 in FIG. 1) in which the first pipe P1 is connected to the second pipe P2, and the third pipe P3 is connected to the fourth pipe P4. In addition, the four-way switching valve 12 in heating operation is controlled to be in a second state (see broken lines of the four-way switching valve 12 in FIG. 1) in which the first pipe P1 is connected to the third pipe P3, and the second pipe P2 is connected to the fourth pipe P4.

The outdoor heat exchanger 15 (corresponding to "heat exchanger" described in the claims) functions as a condenser (or a radiator) of the refrigerant in cooling operation, and functions as an evaporator (or a heater) of the refrigerant in heating operation. The outdoor heat exchanger 15 has a gas-side inlet/outlet 151 connected to the four-way switching valve 12 via the fourth pipe P4, and a liquid-side inlet/outlet 152 connected to the expansion valve 16 via the fifth pipe P5. In cooling operation, the high-pressure gas refrigerant compressed by the compressor 11 flows into the outdoor heat exchanger 15 via the gas-side inlet/outlet 151. In heating operation, the low-pressure liquid refrigerant decompressed by the expansion valve 16 mainly flows into the outdoor heat exchanger 15 via the liquid-side inlet/outlet 152. The outdoor heat exchanger 15 will be described later in more detail in "(4) Details of Outdoor Heat Exchanger 15".

The expansion valve 16 is an electric motor operated valve that decompresses the refrigerant passing through the expansion valve 16 in accordance with the opening degree. The opening degree of the expansion valve 16 is properly controlled in accordance with the circumstance.

Each of the refrigerant pipes (a first pipe P1 to a sixth pipe P6) constitute refrigerant pipes among the devices. The material of each refrigerant pipe is properly selected in accordance with design specification and installation environment. In one or more embodiments, the material is a copper pipe. The first pipe P1 has one end connected to the gas-side connection pipe GP and the other end connected to the four-way switching valve 12. The second pipe P2 has one end connected to the four-way switching valve 12 and the other end connected to the suction port of the compressor 11. The third pipe P3 has one end connected to the discharge port of the compressor 11 and the other end connected to the four-way switching valve 12. The fourth pipe P4 has one end connected to the four-way switching valve 12 and the other end connected to the outdoor heat exchanger 15. The fifth pipe P5 has one end connected to the outdoor heat exchanger 15 and the other end connected to the expansion valve 16. The sixth pipe P6 has one end connected to the expansion valve 16 and the other end connected to the liquid-side connection pipe LP. The refrigerant pipes (P1 to P6) may be constituted of a single pipe, or may be constituted of a plurality of pipes connected to one another via joints in actual situations.

The outdoor fan 18 is a fan that generates an outdoor air flow AF (see arrows indicated by two-dot chain lines in FIGS. 4, 8, and 9) that flows from the outside into the outdoor unit 10, passes through the outdoor heat exchanger 15, and then flows out from the outdoor unit 10. The model of the outdoor fan 18 is selected in accordance with design specification and installation environment, and is, for example, a propeller fan. The outdoor fan 18 includes an outdoor fan motor (not illustrated) serving as a drive source. The number of rotations of the outdoor fan 18 in operation is adjusted in accordance with the circumstance.

The outdoor unit 10 includes various sensors in addition to the above-described devices. For example, the outdoor unit 10 includes an outdoor temperature sensor that detects the temperature of the refrigerant in the outdoor heat exchanger 15, a suction temperature sensor that detects the temperature of the refrigerant to be sucked into the compressor 11, and an outdoor air temperature sensor that detects the temperature of the outdoor air (the outdoor air flow AF).

In addition, the outdoor unit 10 includes an outdoor control unit (not illustrated) that controls the states of the various devices in the outdoor unit 10. The outdoor control unit includes a microcomputer constituted of a microprocessing unit (MPU), a memory, and so forth, and is electrically connected to the various devices and the various sensors. The outdoor control unit in operation controls the state of the refrigerant in the refrigerant circuit RC by controlling the states of the various devices in accordance with the input command and the detection values of the various sensors.

(1-2) Indoor Unit 30

The indoor unit 30 is installed in a target space in which air conditioning is provided. The indoor unit 30 mainly includes, as a device that constitutes the refrigerant circuit RC, an indoor heat exchanger 31. In addition, the indoor unit 30 includes an indoor fan 32 that generates an indoor air flow. The indoor air flow passes through the indoor heat exchanger 31 and exchanges heat with the refrigerant in the indoor heat exchanger 31.

The indoor heat exchanger 31 is a heat exchanger that functions as an evaporator (or a heater) of the refrigerant in cooling operation, and functions as a condenser (or a radiator) of the refrigerant in heating operation. The indoor heat exchanger 31 has a gas-side refrigerant inlet/outlet connected to the gas-side connection pipe GP, and a liquid-side refrigerant inlet/outlet connected to the liquid-side connection pipe LP. In cooling operation, the low-pressure liquid refrigerant decompressed by the expansion valve 16 flows into the indoor heat exchanger 31. In heating operation, the high-pressure gas refrigerant compressed by the compressor 11 flows into the indoor heat exchanger 31.

The indoor fan 32 is a fan that generates an indoor air flow that flows from the target space into the indoor unit 30, passes through the indoor heat exchanger 31, and then flows out to the target space. The model of the indoor fan 32 is selected in accordance with design specification and installation environment, and is, for example, a centrifugal fan, such as a cross-flow fan or a turbo fan. The indoor fan 32 includes an indoor fan motor (not illustrated) serving as a drive source. The number of rotations of the indoor fan 32 in operation is adjusted in accordance with the circumstance.

The indoor unit 30 includes various sensors in addition to the above-described devices. For example, the indoor unit 30 includes an indoor temperature sensor that detects the temperature of the refrigerant in the indoor heat exchanger 31, and a target space temperature sensor that detects the temperature of the target space (the indoor air flow).

In addition, the indoor unit 30 includes an indoor control unit (not illustrated) that controls the states of the various devices in the indoor unit 30. The indoor control unit includes a microcomputer constituted of a microprocessing unit (MPU), a memory, and so forth, and is electrically connected to the various devices, the various sensors, and the outdoor control unit. The indoor control unit in operation controls the state of the refrigerant in the refrigerant circuit RC by controlling the states of the various devices in accordance with the input command and the detection values of the various sensors.

(2) Flow of Refrigerant in Air Conditioner 100

(2-1) Cooling Operation

In cooling operation, the four-way switching valve 12 becomes the first state (the state indicated by solid lines in FIG. 1), the discharge side of the compressor 11 communicates with the gas-side inlet/outlet 151 of the outdoor heat exchanger 15 via the third pipe P3 and the fourth pipe P4, and the suction side of the compressor 11 communicates with the gas-side connection pipe GP via the first pipe P1 and the second pipe P2.

When the compressor 11 is driven, the low-pressure gas refrigerant is sucked into the compressor 11 via the second pipe P2. The refrigerant sucked into the compressor 11 is compressed and discharged as the high-pressure gas refrigerant. The refrigerant discharged from the compressor 11 flows into the gas-side inlet/outlet 151 of the outdoor heat exchanger 15 via the third pipe P3, the four-way switching valve 12 and the fourth pipe P4. The refrigerant flowing into the outdoor heat exchanger 15 exchanges heat with the outdoor air flow AF, is condensed and becomes the high-pressure liquid refrigerant, and flows out from the liquid-side inlet/outlet 152.

The refrigerant flowing out from the outdoor heat exchanger 15 flows into the expansion valve 16 via the fifth pipe P5, is decompressed in accordance with the opening degree of the expansion valve 16, and becomes the low-pressure gas-liquid two-phase refrigerant. The refrigerant passing through the expansion valve 16 flows into the indoor heat exchanger 31 via the sixth pipe P6 and the liquid-side connection pipe LP. The refrigerant flowing into the indoor heat exchanger 31 exchanges heat with the indoor air flow, and is evaporated and becomes the low-pressure gas refrigerant. The refrigerant passing through the indoor heat exchanger 31 is sucked into the compressor 11 again via the gas-side connection pipe GP, the first pipe P1, the four-way switching valve 12, and the second pipe P2.

In this way, in cooling operation, the refrigerant circulates in the refrigerant circuit RC in forward cycle.

(2-2) Heating Operation

In heating operation, the four-way switching valve 12 becomes the second state (the state indicated by broken lines in FIG. 1), the discharge side of the compressor 11 communicates with the gas-side connection pipe GP (the indoor heat exchanger 31) via the first pipe P1 and the third pipe P3, and the suction side of the compressor 11 communicates with the gas-side inlet/outlet 151 of the outdoor heat exchanger 15 via the second pipe P2 and the fourth pipe P4.

When the compressor 11 is driven, the low-pressure gas refrigerant is sucked into the compressor 11 via the second pipe P2. The refrigerant sucked into the compressor 11 is compressed and discharged as the high-pressure gas refrigerant. The refrigerant discharged from the compressor 11 flows into the indoor heat exchanger 31 via the third pipe P3, the four-way switching valve 12, the first pipe P1, and the gas-side connection pipe GP. The refrigerant flowing into the indoor heat exchanger 31 exchanges heat with the indoor air flow, is condensed and becomes the high-pressure liquid refrigerant, and flows out from the indoor heat exchanger 31.

The refrigerant flowing out from the indoor heat exchanger 31 flows into the expansion valve 16 via the liquid-side connection pipe LP and the sixth pipe P6, is decompressed in accordance with the opening degree of the expansion valve 16, and becomes the low-pressure gas-liquid two-phase refrigerant. The refrigerant passing through the expansion valve 16 flows into the liquid-side inlet/outlet 152 of the outdoor heat exchanger 15 via the fifth pipe P5. The refrigerant flowing into the outdoor heat exchanger 15 exchanges heat with the outdoor air flow AF, is evaporated and becomes the low-pressure gas refrigerant, and flows out from the gas-side inlet/outlet 151. The refrigerant flowing out from the outdoor heat exchanger 15 is sucked into the compressor 11 again via the fourth pipe P4, the four-way switching valve 12, and the second pipe P2.

In this way, in heating operation, the refrigerant circulates in the refrigerant circuit RC in reverse cycle.

(3) Details of Outdoor Unit 10

Figure 2:
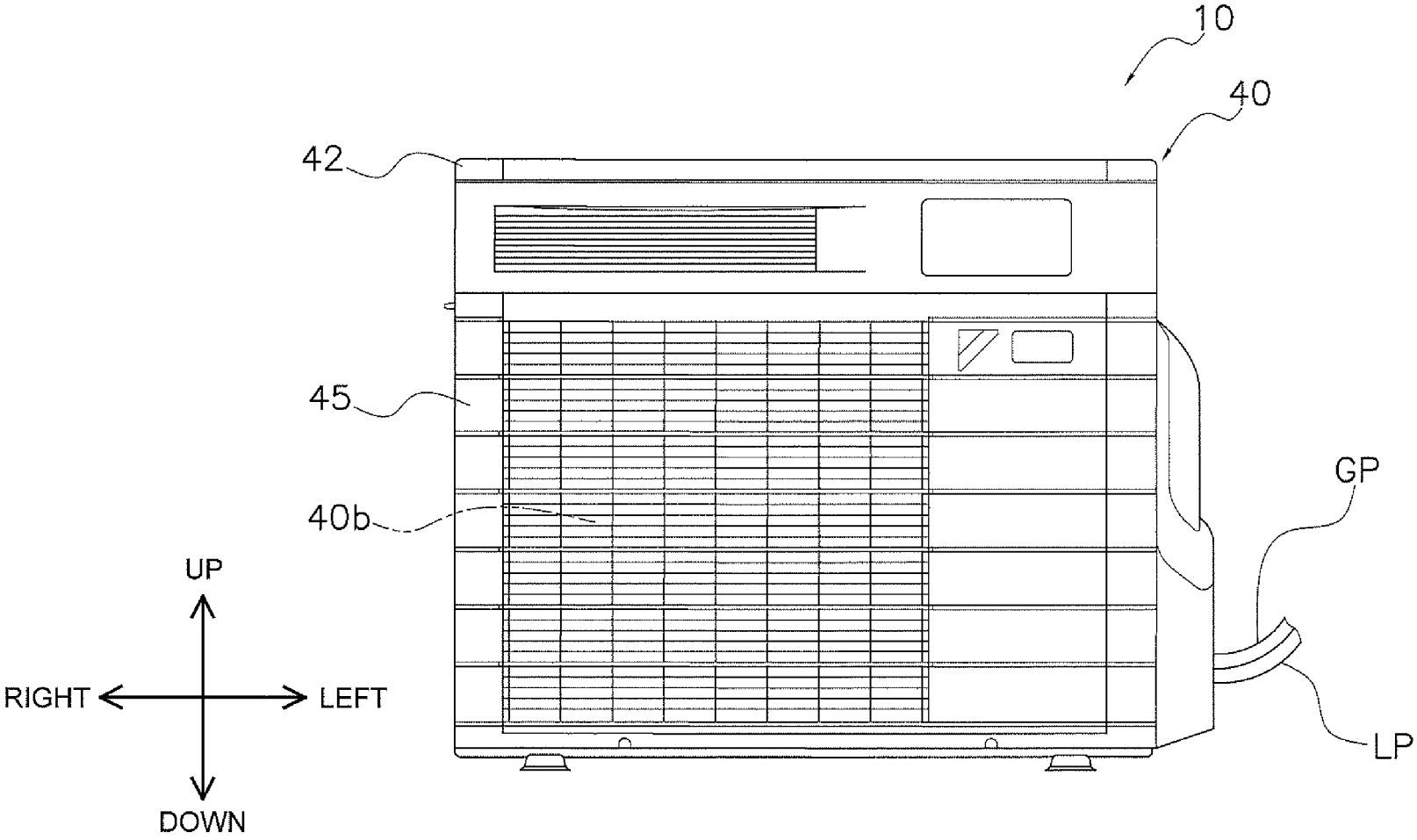
FIG. 2 is a front view of an outdoor unit in accordance with one or more embodiments.
Figure 3:
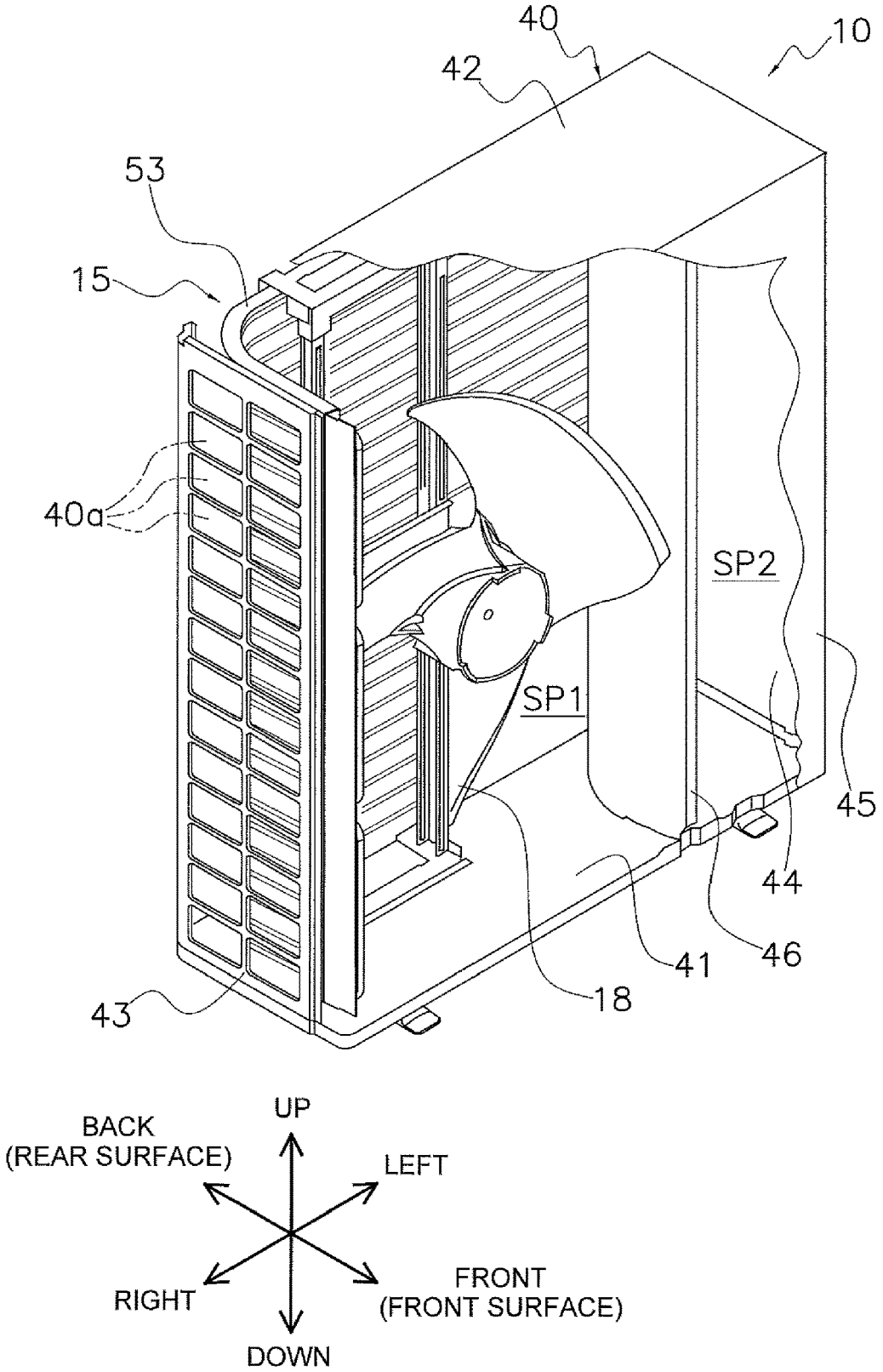
FIG. 3 is a perspective view of the outdoor unit in accordance with one or more embodiments.
Figure 4:
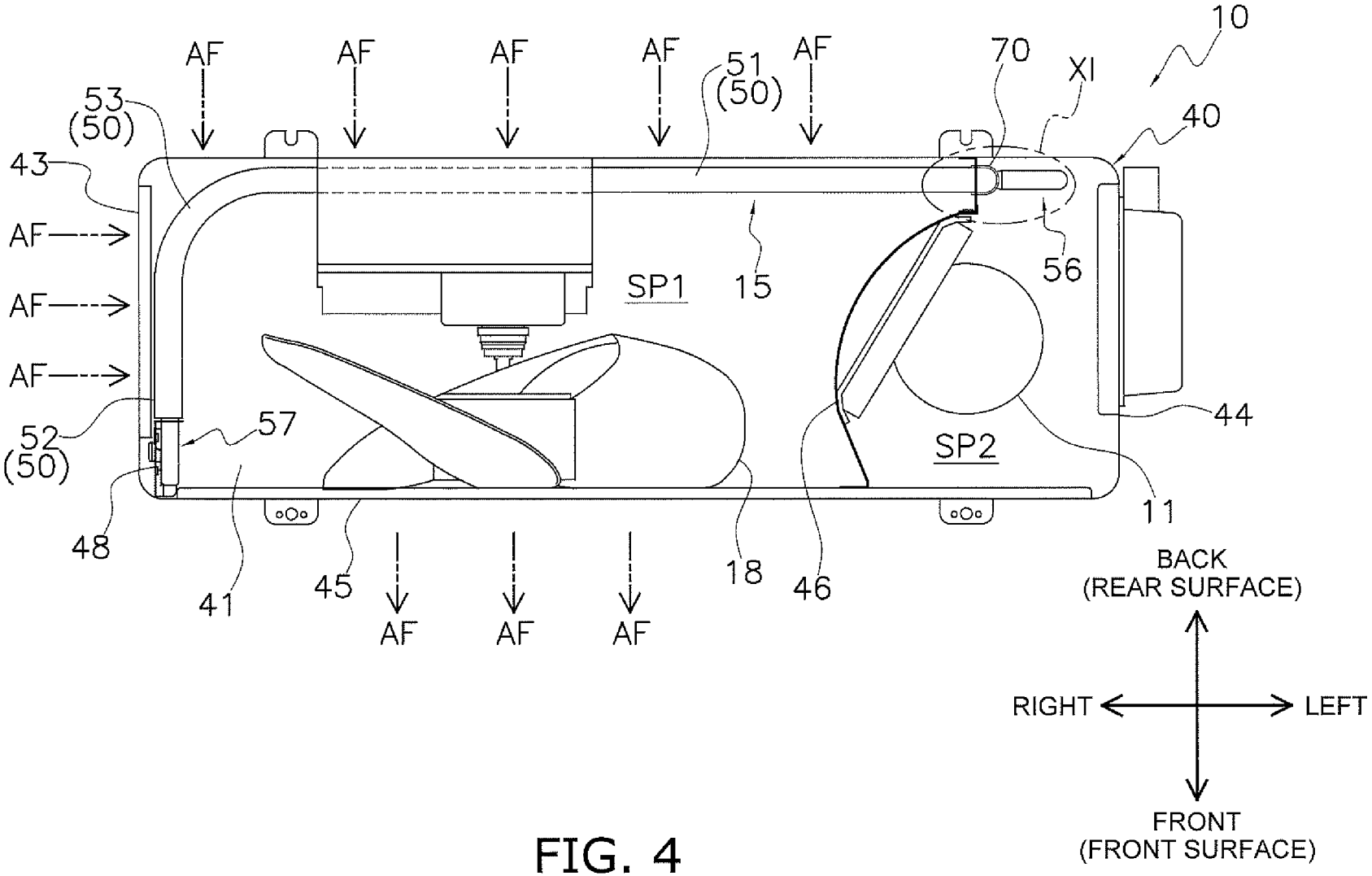
FIG. 4 is a horizontal sectional view of the outdoor unit in accordance with one or more embodiments.

FIG. 2 is a front view of the outdoor unit 10. FIG. 3 is a perspective view of the outdoor unit 10. FIG. 4 is a horizontal sectional view of the outdoor unit 10. FIGS. 3 and 4 omit illustration of part of the devices disposed in the outdoor unit 10.

The outdoor unit 10 is installed outside the target space in which the indoor unit 30 is disposed. For example, the outdoor unit 10 is installed at an outside location or in a basement. The outdoor unit 10 has a substantially rectangular-parallelepiped outer contour, and includes a unit casing 40 (corresponding to "casing" described in the claims) that houses the devices. The unit casing 40 includes a bottom plate 41 that constitutes a bottom-surface portion, a top panel 42 that constitutes a top-surface portion, a right-side panel 43 that mainly constitutes a right-side portion, a left-side panel 44 that mainly constitutes a left-side portion and a left-rear portion, and a front panel 45 that constitutes a front-surface portion.

The unit casing 40 has a suction port 40*a* that is formed at the rear and right-side portion thereof and that takes the outdoor air flow AF into the unit casing 40. In addition, the unit casing 40 has a blow-out port 40*b* that is formed at the front-surface portion thereof and that is an outlet of the taken-in outdoor air flow AF.

The unit casing 40 forms therein a fan chamber SP1 and a machine chamber SP2. More specifically, a partition plate 46 is disposed in the unit casing 40. The partition plate 46 divides the inner space of the unit casing 40 into the fan chamber SP1 and the machine chamber SP2. The partition plate 46 is disposed on the left side with respect to the center on the bottom plate 41.

The fan chamber SP1 (corresponding to "first space" described in the claims) is a space located on the right side in the unit casing 40. In the fan chamber SP1, a heat exchange portion 50 (described later) and a second end portion 57 (described later) of the outdoor heat exchanger 15, and devices such as the outdoor fan 18 are disposed. The fan chamber SP2 (corresponding to "second space" described in the claims) is a space located on the left side in the unit casing 40. In the machine chamber SP2, the compressor 11, the four-way switching valve 12, the expansion valve 16, and a header collecting tube 70 (described later) of the outdoor heat exchanger 15 are disposed.

(4) Details of Outdoor Heat Exchanger 15

(4-1) Configuration Aspect of Outdoor Heat Exchanger 15

Figure 5:
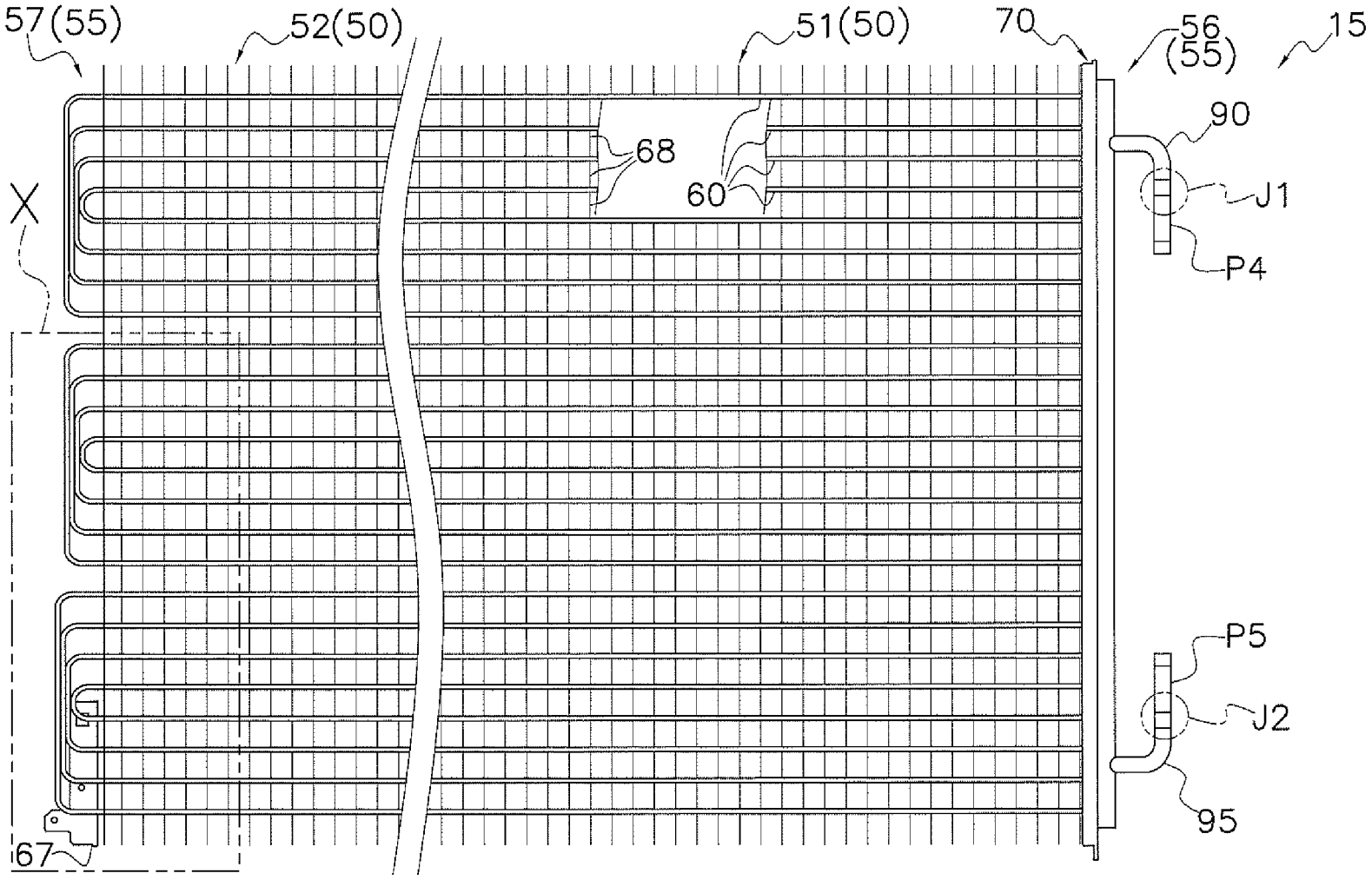
FIG. 5 is a front view of an outdoor heat exchanger in accordance with one or more embodiments.
Figure 6:
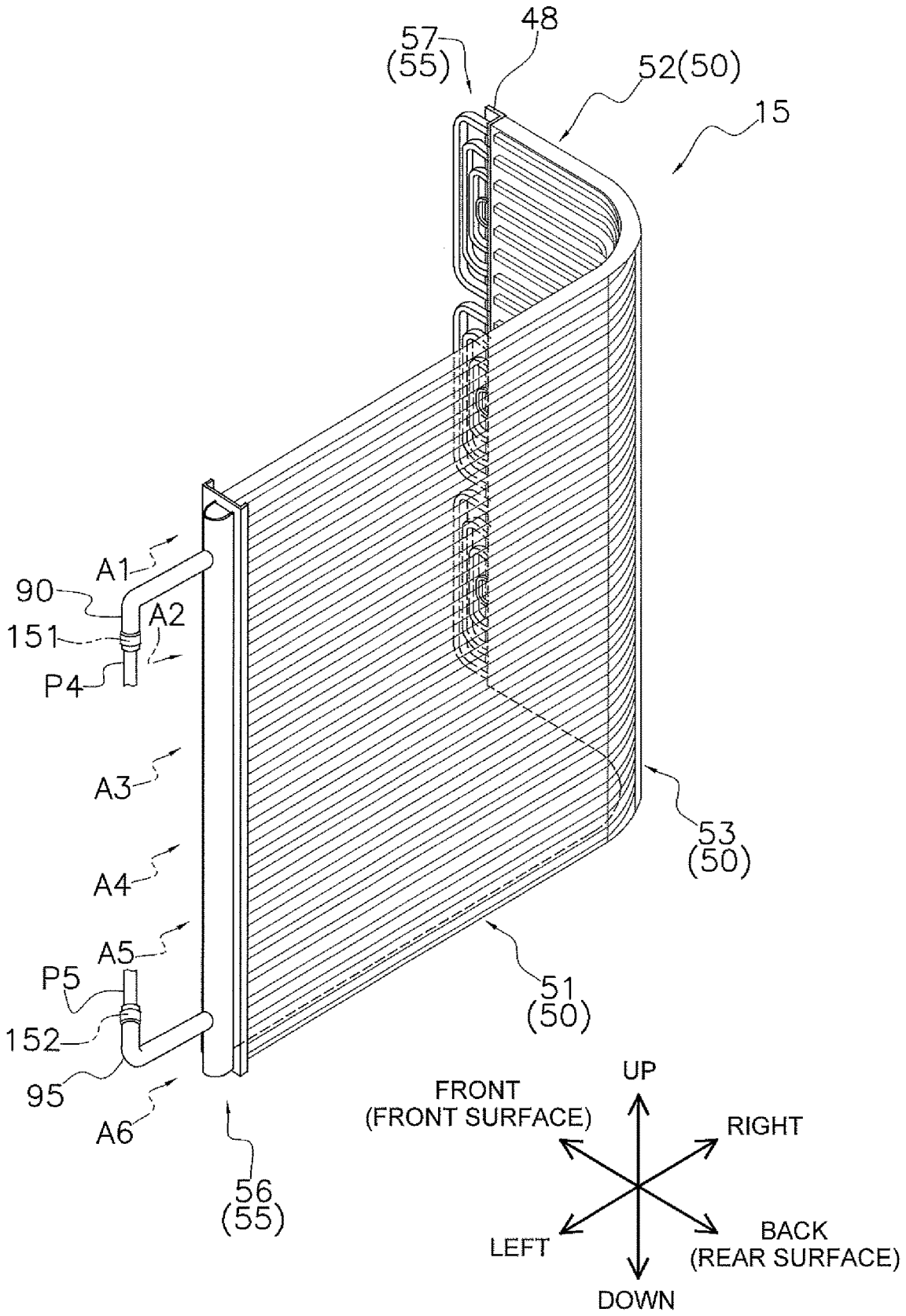
FIG. 6 is a perspective view of the outdoor heat exchanger in accordance with one or more embodiments.

FIG. 5 is a front view of the outdoor heat exchanger 15. FIG. 6 is a perspective view of the outdoor heat exchanger 15. The outdoor heat exchanger 15 is disposed to extend to the fan chamber SP1 and the machine chamber SP2 in the unit casing 40 (mainly disposed in the fan chamber SP1). The outdoor heat exchanger 15 has a substantially L-like shape in plan view. The outdoor heat exchanger 15 is disposed on the bottom plate 41 to extend along the suction port 40*a* formed at a rear-surface portion and a right-side-surface portion of the unit casing 40.

The outdoor heat exchanger 15 mainly includes a heat exchange portion 50, a first end portion 56 and a second end portion 57 (hereinafter, the first end portion 56 and the second end portion 57 are collectively referred to as "both end portions 55").

Figure 7:
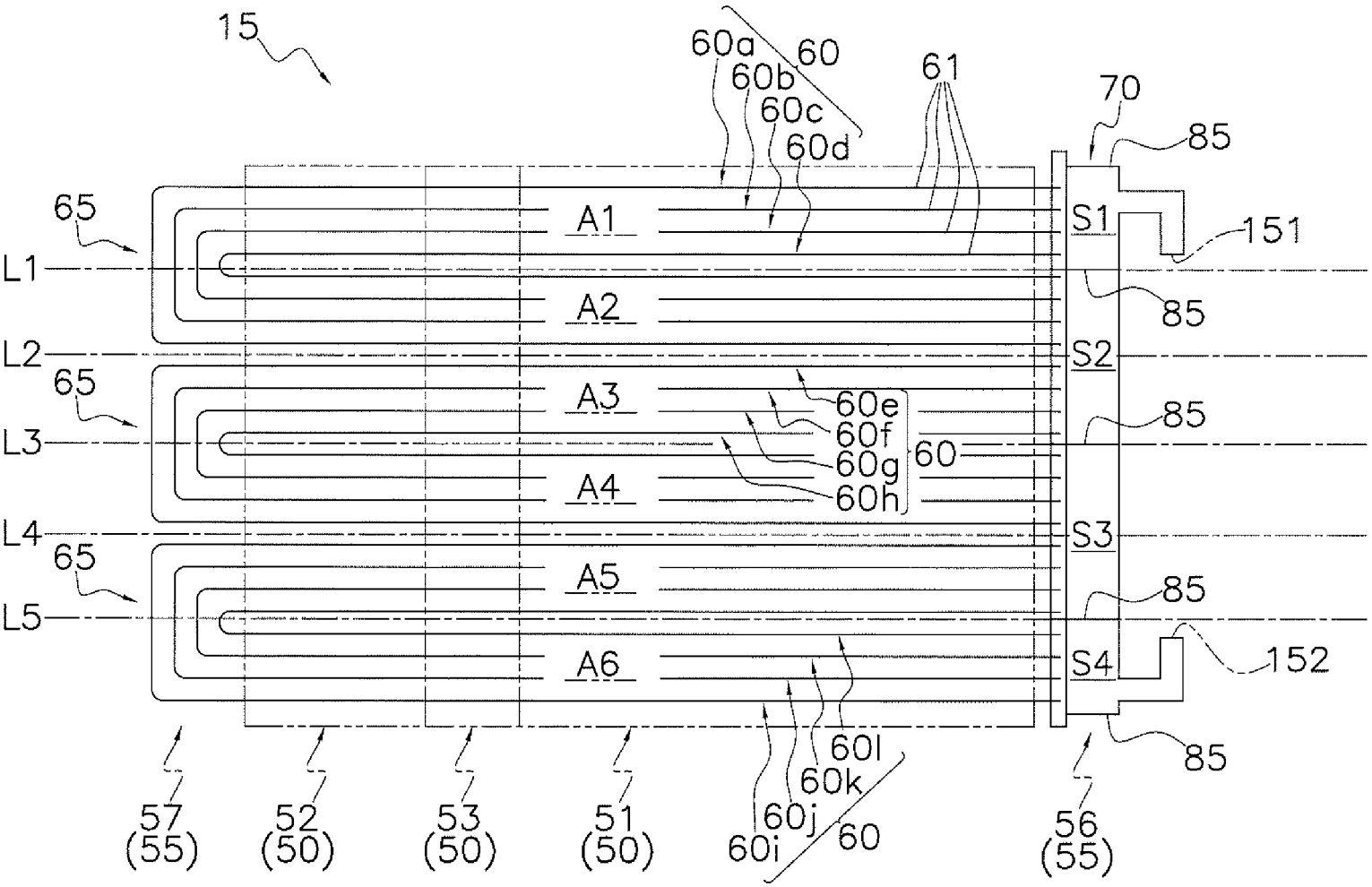
FIG. 7 is a diagram schematically illustrating a heat exchange portion and both end portions in accordance with one or more embodiments.

FIG. 7 is a diagram schematically illustrating the heat exchange portion 50 and the both end portions 55. The heat exchange portion 50 is a portion that causes the refrigerant and the outdoor air flow AF to exchange heat. The heat exchange portion 50 is located in the fan chamber SP1. The outdoor heat exchanger 15 mainly includes, as heat exchange portions 50, a first heat exchange portion 51, a second heat exchange portion 52, and a third heat exchange portion 53. The first heat exchange portion 51, the second heat exchange portion 52, and the third heat exchange portion 53 are described in a divided manner for the convenience of explanation although the first to third heat exchange portions 51 to 53 continuously extend and are integrally formed.

The first heat exchange portion 51 is a portion extending in the left-right direction along the suction port 40*a* at the rear-surface portion in the unit casing 40. The second heat exchange portion 52 is a portion extending in the front-rear direction along the suction port 40*a* at the right-side-surface portion in the unit casing 40. The third heat exchange portion 53 is a portion that couples the first heat exchange portion 51 to the second heat exchange portion 52. The third heat exchange portion 53 is connected to an end portion on the right side of the first heat exchange portion 51, and also connected to an end portion on the rear side of the second heat exchange portion 52. The third heat exchange portion 53 extends from the rear-surface portion to the right-side-surface portion while being curved at a position corresponding to the rear right portion of the outdoor heat exchanger 15 in the unit casing 40.

The both end portions 55 are portions corresponding to end portions in the heat-transfer-tube extending direction of the outdoor heat exchanger 15 (in this case, the horizontal direction in the installed state). The first end portion 56 mainly constitutes an end portion on the left side of the outdoor heat exchanger 15. The first end portion 56 is adjacent to the left side of the first heat exchange portion 51. The first end portion 56 is located in the fan chamber SP2. The outdoor heat exchanger 15 includes a header collecting tube 70 at which the gas-side inlet/outlet 151 and the liquid-side inlet/outlet 152 are formed at the first end portion 56. The header collecting tube 70 will be described later in more detail.

The second end portion 57 is a portion that constitutes an end portion on the side opposite to the first end portion 56. The second end portion 57 is adjacent to the front-surface side of the second heat exchange portion 52. The second end portion 57 is shielded by a shielding plate 48 from the outdoor air flow AF in the installed state (see FIG. 4). At the second end portion 57, a tube plate 67 that supports heat transfer tubes 60 (60*i* to 60*l*, described later) is disposed.

The outdoor heat exchanger 15 including the heat exchange portions 50 and the both end portions 55 according to one or more embodiments is divided into a plurality of (in this case, six) regions as illustrated in FIG. 7. Specifically, the outdoor heat exchanger 15 is divided into a first region A1, a second region A2, a third region A3, a fourth region A4, a fifth region A5, and a sixth region A6.

The first region A1 is a portion located above a one-dot chain line L1 of the outdoor heat exchanger 15. The first region A1 is a region where the gas refrigerant in a superheated state flows during operation.

The second region A2 is a portion located between the one-dot chain line L1 and a one-dot chain line L2 of the outdoor heat exchanger 15. The third region A3 is a portion located between the one-dot chain line L2 and a one-dot chain line L3 of the outdoor heat exchanger 15.

The fourth region A4 is a portion located between the one-dot chain line L3 and a one-dot chain line L4 of the outdoor heat exchanger 15. The fifth region A5 is a portion located between the one-dot chain line L4 and a one-dot chain line L5 of the outdoor heat exchanger 15.

The sixth region A6 is a portion located below the one-dot chain line L5 of the outdoor heat exchanger 15. The sixth region A6 is a region where the liquid refrigerant in a subcooled state flows during heating operation.

The header collecting tube 70 forms therein a plurality of spaces. More specifically, a plurality of (in this case, five) horizontal partition plates 85 (described later) extending in the horizontal direction are disposed in the header collecting tube 70, and form a plurality of inner spaces (a first header inner space S1 to a fourth header inner space S4). The refrigerant comes into and out from the inner spaces. Specifically, in the header collecting tube 70, the first header inner space S1, the second header inner space S2, the third header inner space S3, and the fourth header inner space S4 are disposed in that order from the upper side to the lower side.

The first header inner space S1 is a space located in the first region A1. The second header inner space S2 is a space located in the second region A2 and the third region A3. The third header inner space S3 is a space located in the fourth region A4 and the fifth region A5. The fourth header inner space S4 is a space located in the sixth region A6.

In addition, the header collecting tube 70 has the gas-side inlet/outlet 151 that communicates with the first header inner space S1, and the liquid-side inlet/outlet 152 that communicates with the fourth header inner space S4.

The outdoor heat exchanger 15 includes a plurality of (in this case, twelve) heat transfer tubes 60 through which the refrigerant flows. Specifically, the outdoor heat exchanger 15 includes a first heat transfer tube 60*a*, a second heat transfer tube 60*b*, a third heat transfer tube 60*c*, and a fourth heat transfer tube 60*d* extending in parallel to one another in the first region A1 and the second region A2. In addition, the outdoor heat exchanger 15 includes a fifth heat transfer tube 60*e*, a sixth heat transfer tube 60*f*, a seventh heat transfer tube 60*g*, and an eighth heat transfer tube 60*h* extending in parallel to one another in the third region A3 and the fourth region A4. Furthermore, the outdoor heat exchanger 15 includes a ninth heat transfer tube 60*i*, a tenth heat transfer tube 60*j*, an eleventh heat transfer tube 60*k*, and a twelfth heat transfer tube 60*l* extending in parallel to one another in the fifth region A5 and the sixth region A6.

The heat transfer tubes 60 (60*a* to 60*l*) have one ends and the other ends connected to the header collecting tube 70. More specifically, the heat transfer tubes 60 (60*a* to 60*d*) disposed in the first region A1 and the second region A2 are connected to the header collecting tube 70 so that one ends thereof communicate with the first header inner space S1 and the other ends thereof communicate with the second header inner space S2. In addition, the heat transfer tubes 60 (60*e* to 60*h*) disposed in the third region A3 and the fourth region A4 are connected to the header collecting tube 70 so that one ends thereof communicate with the second header inner space S2 and the other ends thereof communicate with the third header inner space S3. Furthermore, the heat transfer tubes 60 (60*i* to 60*l*) disposed in the fifth region A5 and the sixth region A6 are connected to the header collecting tube 70 so that one ends thereof communicate with the third header inner space S3 and the other ends thereof communicate with the fourth header inner space S4.

Each of the heat transfer tubes 60 includes an extension portion 61 that extends in the horizontal direction at the heat exchange portions 50. In addition, each of the heat transfer tubes 60 includes a fold-back portion 65 at which the heat transfer tube 60 is folded back in a substantially U-like shape toward another region (in this case, one-step lower region) at the second end portion 57. At each fold-back portion 65, the corresponding heat transfer tube 60 mainly extends in the up-down direction.

Specifically, the first heat transfer tube 60*a* to the fourth heat transfer tube 60*d* are folded back at the second end portion 57 from the first region A1 to the lower second region A2. In addition, the fifth heat transfer tube 60*e* to the eighth heat transfer tube 60*h* are folded back at the second end portion 57 from the third region A3 to the lower fourth region A4. Furthermore, the ninth heat transfer tube 60*i* to the twelfth heat transfer tube 60*l* are folded back at the second end portion 57 from the fifth region A5 to the lower sixth region A6. The ninth heat transfer tube 60*i* to the twelfth heat transfer tube 60*l* are inserted into and supported by the tube plate 67 at the second end portion 57.

The heat transfer tubes 60 (60*a* to 60*d*) according to one or more embodiments are arranged in the first region A1 in the order of the first heat transfer tube 60*a*, the second heat transfer tube 60*b*, the third heat transfer tube 60*c*, and the fourth heat transfer tube 60*d* from the upper side to the lower side; are arranged at the fold-back portion 65 in the order of the first heat transfer tube 60*a*, the second heat transfer tube 60*b*, the third heat transfer tube 60*c*, and the fourth heat transfer tube 60*d* from the outer side to the inner side; and are arranged in the second region A2 in the order of the fourth heat transfer tube 60*d*, the third heat transfer tube 60*c*, the second heat transfer tube 60*b*, and the first heat transfer tube 60*a* from the upper side to the lower side.

In addition, the heat transfer tubes 60 (60*e* to 60*h*) are arranged in the third region A3 in the order of the fifth heat transfer tube 60*e*, the sixth heat transfer tube 60*f*, the seventh heat transfer tube 60*g*, and the eighth heat transfer tube 60*h* from the upper side to the lower side; are arranged at the fold-back portion 65 in the order of the fifth heat transfer tube 60*e*, the sixth heat transfer tube 60*f*, the seventh heat transfer tube 60*g*, and the eighth heat transfer tube 60*h* from the outer side to the inner side; and are arranged in the fourth region A4 in the order of the eighth heat transfer tube 60*h*, the seventh heat transfer tube 60*g*, the sixth heat transfer tube 60*f*, and the fifth heat transfer tube 60*e* from the upper side to the lower side.

Furthermore, the heat transfer tubes 60 (60*i* to 60*l*) are arranged in the fifth region A5 in the order of the ninth heat transfer tube 60*i*, the tenth heat transfer tube 60*j*, the eleventh heat transfer tube 60*k*, and the twelfth heat transfer tube 60*l* from the upper side to the lower side; are arranged at the fold-back portion 65 in the order of the ninth heat transfer tube 60*i*, the tenth heat transfer tube 60*j*, the eleventh heat transfer tube 60*k*, and the twelfth heat transfer tube 60*l* from the outer side to the inner side; and are arranged in the sixth region A6 in the order of the twelfth heat transfer tube 60*l*, the eleventh heat transfer tube 60*k*, the tenth heat transfer tube 60*j*, and the ninth heat transfer tube 60*i* from the upper side to the lower side.

Figure 8:
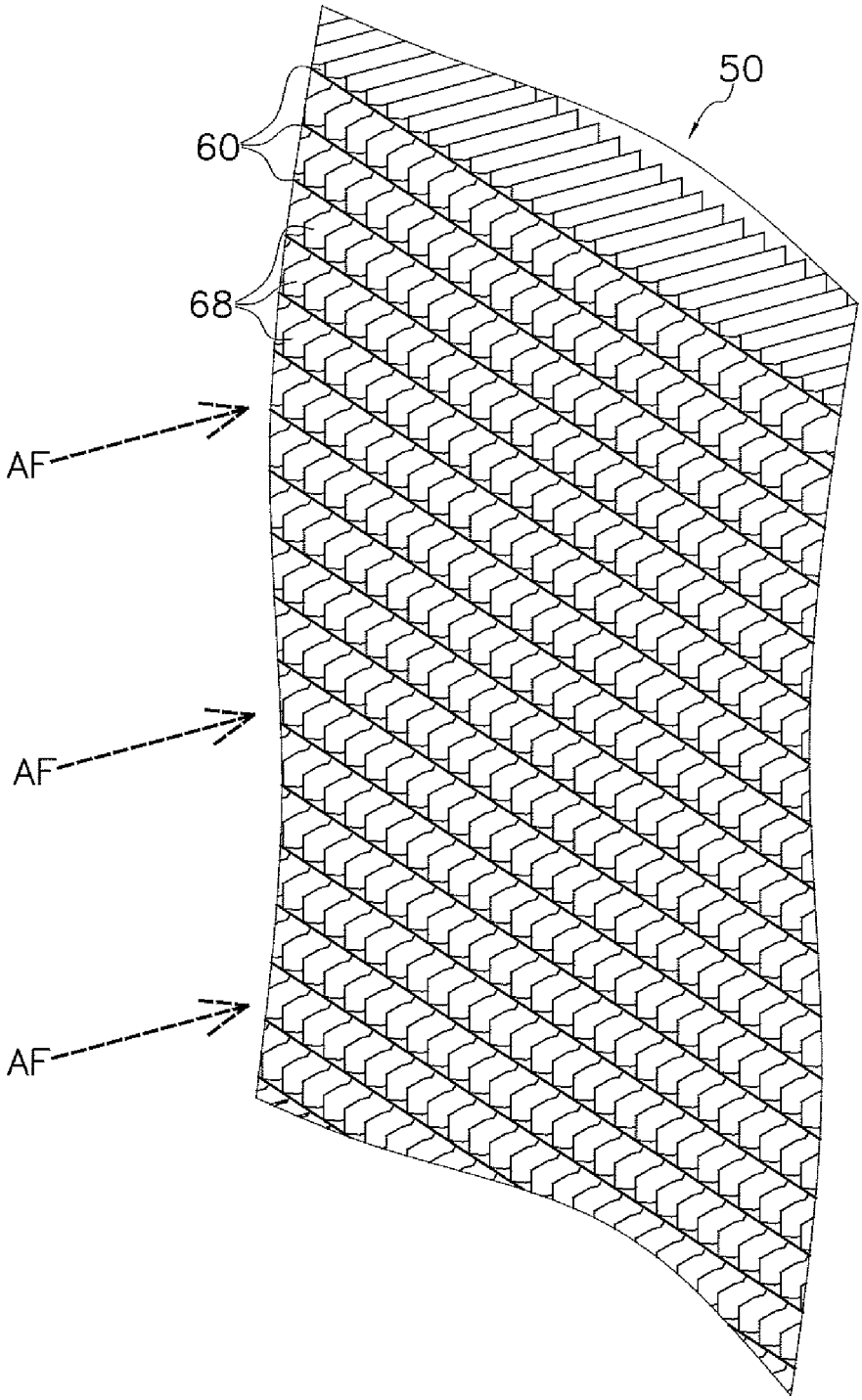
FIG. 8 is a perspective view of the heat exchange portion in a view from a flow direction of an outdoor air flow in accordance with one or more embodiments.
Figure 9:
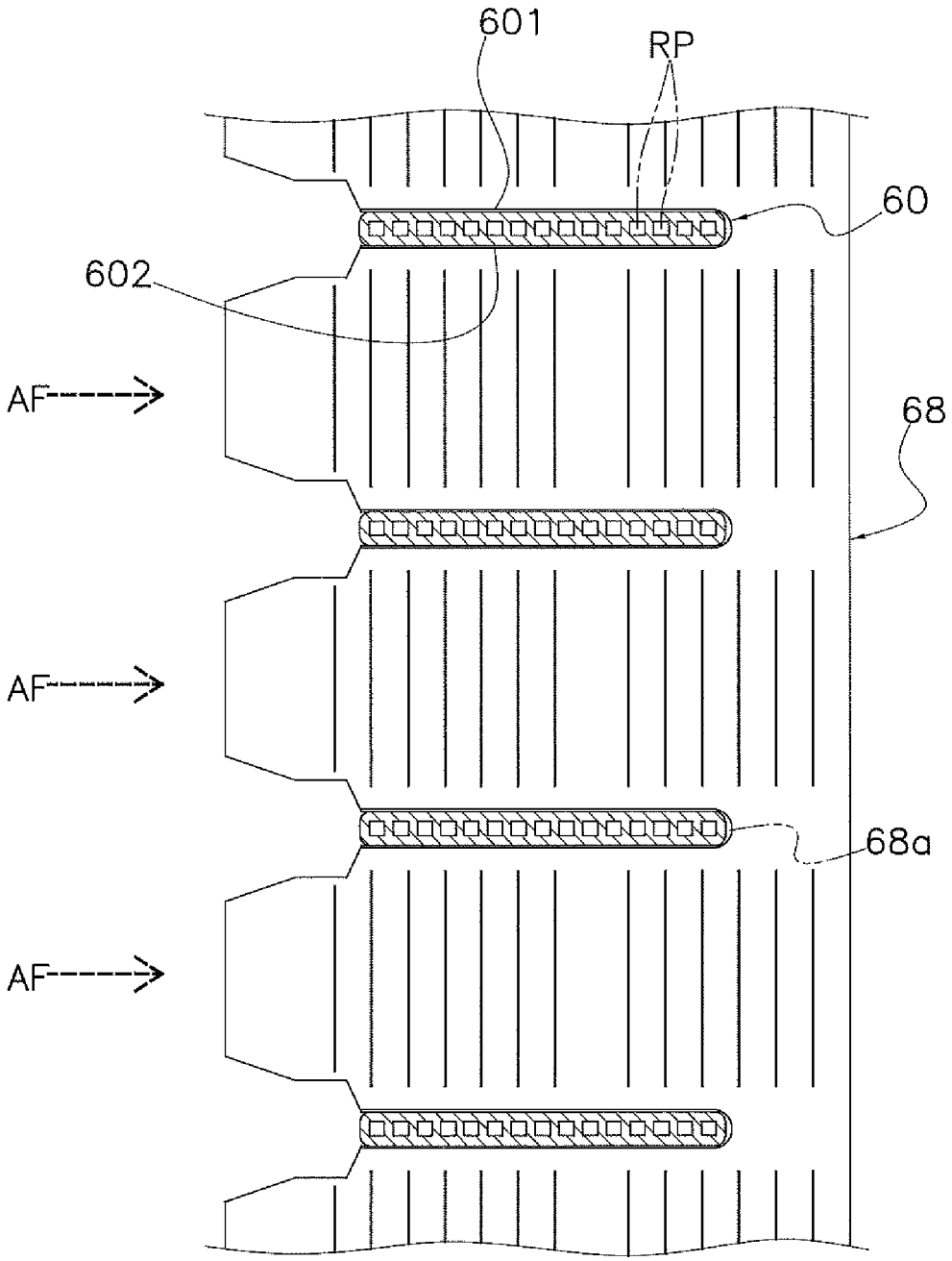
FIG. 9 is a schematic diagram of heat transfer tubes and heat transfer fins in a view from a heat-transfer-tube extending direction in accordance with one or more embodiments.

As described above, in the outdoor heat exchanger 15, the plurality of heat transfer tubes 60 extending along the heat-transfer-tube extending direction (in this case, the horizontal direction, in particular, in the left-right direction at the first heat exchange portion 51, in the front-rear direction at the second heat exchange portion 52) are stacked at intervals in the heat-transfer-tube stacking direction (in this case, the up-down direction). The heat-transfer-tube extending direction is aligned with the direction in which the heat exchange portions 50 extend in plan view. FIG. 8 is a perspective view of the heat exchange portion 50 in a view from the flow direction of the outdoor air flow AF. FIG. 9 is a schematic diagram of the heat transfer tubes 60 and heat transfer fins 68 in a view from the heat-transfer-tube extending direction.

Each heat transfer tube 60 is a flat tube made of aluminum or an aluminum alloy and formed in a flat shape. More specifically, the heat transfer tube 60 is a flat porous tube having a plurality of refrigerant channels RP formed in the tube. The plurality of refrigerant channels RP are arranged in the heat transfer tube 60 along the flow direction of the outdoor air flow AF. Each heat transfer tube 60 has two main surfaces (a first main surface 601 and a second main surface 602).

The first main surface 601 faces the upper side at corresponding one of the extension portions 61 located in the first region A1, the third region A3, and the fifth region A5; and faces the lower side at corresponding one of the extension portions 61 located in the second region A2, the fourth region A4, and the sixth region A6. The first main surface 601 faces the outer side of the outdoor heat exchanger 15 at corresponding one of the fold-back portions 65 (the side opposite to the heat exchange portions 50).

The second main surface 602 faces the lower side at corresponding one of the extension portions 61 located in the first region A1, the third region A3, and the fifth region A5; and faces the upper side at corresponding one of the extension portions 61 located in the second region A2, the fourth region A4, and the sixth region A6. The second main surface 602 faces the inner side of the outdoor heat exchanger 15 at corresponding one of the fold-back portions 65.

The outdoor heat exchanger 15 includes a plurality of heat transfer fins 68 arranged along the longitudinal direction (the horizontal direction in the installed state) of the heat transfer tubes 60 at each heat exchange portion 50. The heat transfer fins 68 each are a flat-plate-shaped member (a plate fin) that increases the heat transfer area of the corresponding heat transfer tube 60 with respect to the outdoor air flow AF. The heat transfer fin 68 is made of aluminum or an aluminum alloy. The heat transfer fin 68 extends along the heat-transfer-tube stacking direction to intersect with the corresponding heat transfer tube 60 at each heat exchange portion 50.

The heat transfer fin 68 has a plurality of slits 68*a* to be arranged in the heat-transfer-tube stacking direction. To each slit 68*a*, the corresponding heat transfer tube 60 is inserted. The heat transfer fin 68 is in contact with the heat transfer tube 60 at an edge portion of each slit 68*a*, and is thermally connected to the heat transfer tube 60. Each heat transfer fin 68 is joined by brazing to the heat transfer tube 60 at the joint portion to the heat transfer tube 60. More specifically, each heat transfer fin 68 is brazed by furnace brazing in a state temporarily assembled with the heat transfer tube 60 (in a state in which the heat transfer tube 60 is inserted into the slit 68*a*).

The heat transfer fin 68 is not disposed at the both end portions 55 of the outdoor heat exchanger 15. That is, the heat transfer fin 68 is not in contact with the fold-back portions 65 of the heat transfer tube 60.

Figure 10:
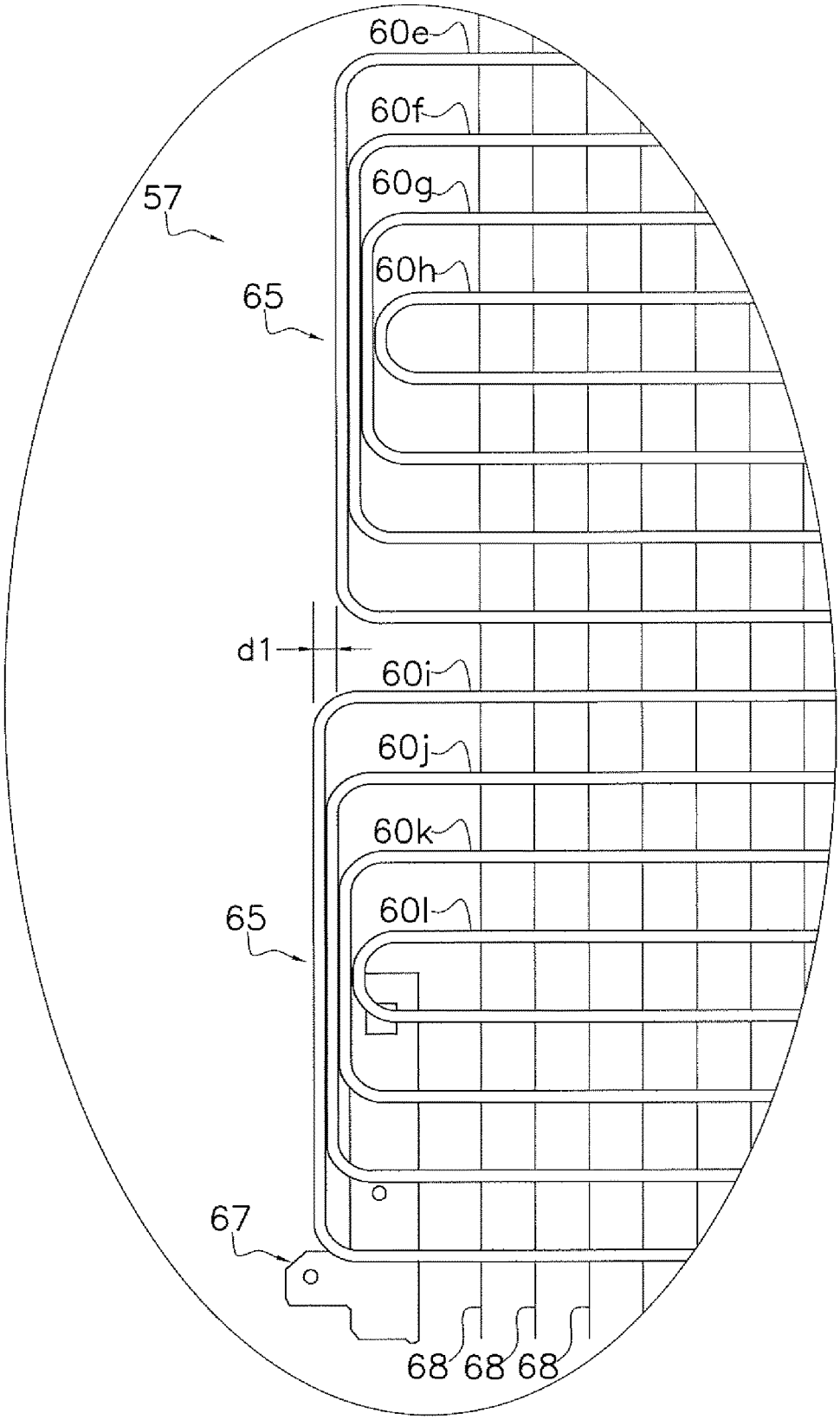
FIG. 10 is an enlarged view of area X in FIG. 5 in accordance with one or more embodiments.

FIG. 10 is an enlarged view of area X in FIG. 5. As illustrated in FIG. 10, the heat transfer tubes (60*i* to 60*l*) disposed in the fifth region A5 and the sixth region A6 are longer than the heat transfer tubes (60*e* to 60*h*) disposed in the third region A3 and the fourth region A4 and the heat transfer tubes (60*a* to 60*d*) disposed in the first region A1 and the second region A2 to have a protruding length at the fold-back portion 65 (specifically, a dimension in the horizontal direction at the second end portion 57, and a dimension in the horizontal direction on the outer side with respect to the heat transfer fins 68 disposed on the outermost side), by a length corresponding to a dimension d1.

More specifically, the ninth heat transfer tube 60*i* is longer than the first heat transfer tube 60*a* and the fifth heat transfer tube 60*e* to have a protruding length at the fold-back portion 65 by a length corresponding to the dimension d1. The tenth heat transfer tube 60*j* is longer than the second heat transfer tube 60*b* and the sixth heat transfer tube 60*f* to have a protruding length at the fold-back portion 65 by a length corresponding to the dimension d1. The eleventh heat transfer tube 60*k* is longer than the third heat transfer tube 60*c* and the seventh heat transfer tube 60*g* to have a protruding length at the fold-back portion 65 by a length corresponding to the dimension d1. The twelfth heat transfer tube 60*l* is longer than the fourth heat transfer tube 60*d* and the eighth heat transfer tube 60*h* to have a protruding length at the fold-back portion 65 by a length corresponding to the dimension d1.

According to one or more embodiments, the protruding lengths of the heat transfer tubes 60 at the fold-back portions 65 vary depending on the region in the viewpoint of suppressing a decrease in reliability and suppressing an increase in cost as described below.

In the flat-tube heat exchanger including the flat-plate-shaped heat transfer fins 68 like the outdoor heat exchanger 15, the heat transfer fins 68 are desirably inserted into the heat transfer tubes 60 (the extension portions 61) at positions separated from the curved fold-back portions 65 in the viewpoint of suppressing deformation of the heat transfer fins 68. In addition, the tube plate 67 is desirably inserted into the heat transfer tubes 60 at a position separated from the fold-back portions 65 in the viewpoint of suppressing deformation. That is, in such a flat-tube heat exchanger, a dimension (a dimension of each heat transfer tube 60) to suppress deformation of the heat transfer fins 68 or the tube plate 67 is desirably ensured between each heat transfer tube 60 and the heat transfer fin 68 located on the outermost side, or between each heat transfer tube 60 and the tube plate 67 to suppress a decrease in reliability.

However, if the dimension is excessively increased, the length of the heat transfer tubes 60 increases, and the cost increases by the amount of the increased length.

In the outdoor heat exchanger 15, the heat transfer tubes 60 disposed in the fifth region A5 and the sixth region A6 (the heat transfer tubes 60*i* to 60*l* supported by the tube plate 67) are longer than the heat transfer tubes 60 disposed in the other regions (the heat transfer tubes 60*a* to 60*h* not supported by the tube plate 67) to have the larger protruding length corresponding to the dimension d1. Thus, the deformation of the tube plate 67 and the heat transfer fins 68 is suppressed, and a decrease in reliability is suppressed. In addition, since the heat transfer tubes 60 disposed in the first region A1 to the fourth region A4 (the heat transfer tubes 60*a* to 60*h* not supported by the tube plate 67) are shorter than the heat transfer tubes 60 (60*i* to 60*l*) disposed in the fifth region A5 and the sixth region A6 to have the smaller protruding length (more specifically, the protruding length is a minimally required protruding length for properly inserting the heat transfer fins 68), the pipe length is short enough and an increase in cost is suppressed.

(4-2) Flow of Refrigerant in Outdoor Heat Exchanger 15

In cooling operation (in forward cycle operation), the refrigerant flows into the fourth header inner space S4 via the liquid-side inlet/outlet 152. The refrigerant flowing into the fourth header inner space S4 flows through the sixth region A6 and the fifth region A5, and is folded back from the fifth region A5 to the fourth region A4 in the third header inner space S3. Then, the refrigerant flows through the fourth region A4 and the third region A3, and is folded back from the third region A3 to the second region A2 in the second header inner space S2. Then, the refrigerant flows through the second region A2 and the first region A1, and flows into the first header inner space S1, and flows out via the gas-side inlet/outlet 151. In other words, in cooling operation, the liquid-side inlet/outlet 152 functions as the inlet of the refrigerant, and the gas-side inlet/outlet 151 functions as the outlet of the refrigerant. The sixth region A6 functions as the most upstream forward path of the refrigerant, the fourth region A4 functions as the downstream forward path of the refrigerant, and the second region A2 functions as the most downstream forward path of the refrigerant. The fifth region A5 functions as the most upstream return path of the refrigerant, the third region A3 functions as the downstream return path of the refrigerant, and the first region A1 functions as the most downstream return path of the refrigerant.

In heating operation (in reverse cycle operation), the refrigerant flows into the first header inner space S1 via the gas-side inlet/outlet 151. The refrigerant flowing into the first header inner space S1 flows through the first region A1 and the second region A2, and is folded back from the second region A2 to the third region A3 in the second header inner space S2. Then, the refrigerant flows through the third region A3 and the fourth region A4, and is folded back from the fourth region A4 to the fifth region A5 in the third header inner space S3. Then, the refrigerant flows through the fifth region A5 and the sixth region A6, and flows into the fourth header inner space S4, and flows out via the liquid-side inlet/outlet 152. In other words, in heating operation, the gas-side inlet/outlet 151 functions as the inlet of the refrigerant, and the liquid-side inlet/outlet 152 functions as the outlet of the refrigerant. The first region A1 functions as the most upstream forward path of the refrigerant, the third region A3 functions as the downstream forward path of the refrigerant, and the fifth region A5 functions as the most downstream forward path of the refrigerant. The second region A2 functions as the most upstream return path of the refrigerant, the fourth region A4 functions as the downstream return path of the refrigerant, and the sixth region A6 functions as the most downstream return path of the refrigerant.

(5) Details of Header Collecting Tube 70

Figure 11:
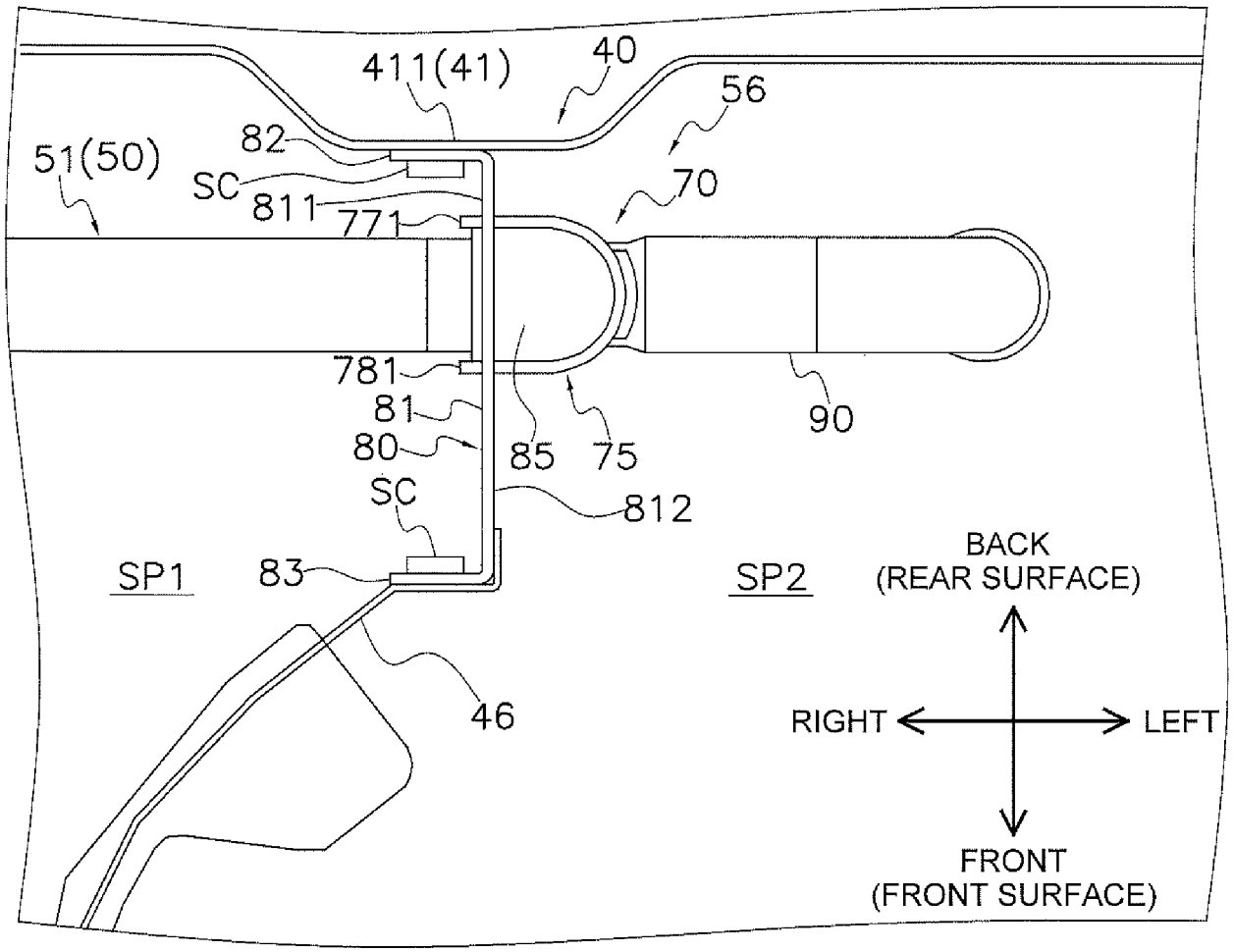
FIG. 11 is an enlarged view of area XI in FIG. 4 in accordance with one or more embodiments.
Figure 12:
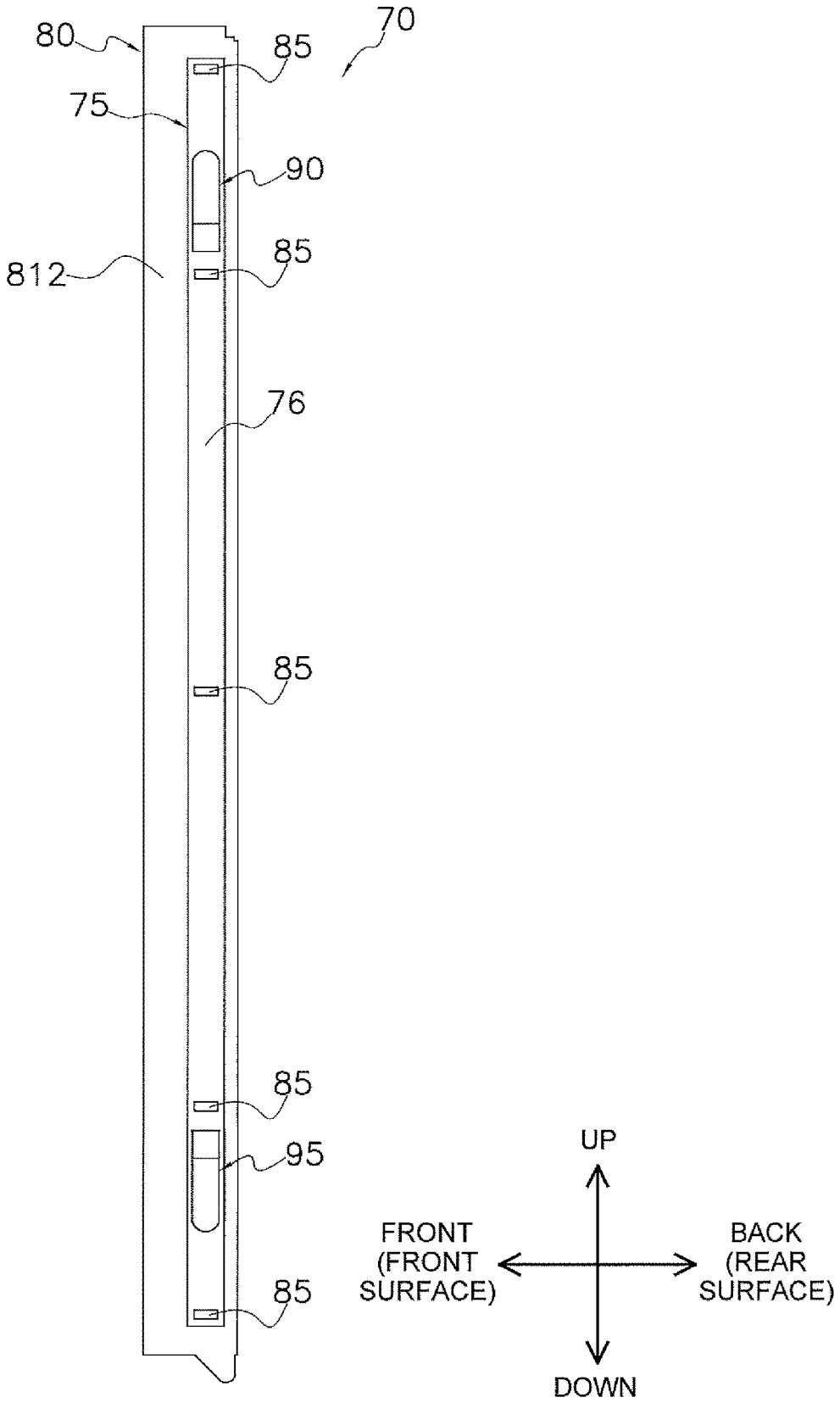
FIG. 12 is a left side view of a header collecting tube in accordance with one or more embodiments.
Figure 13:
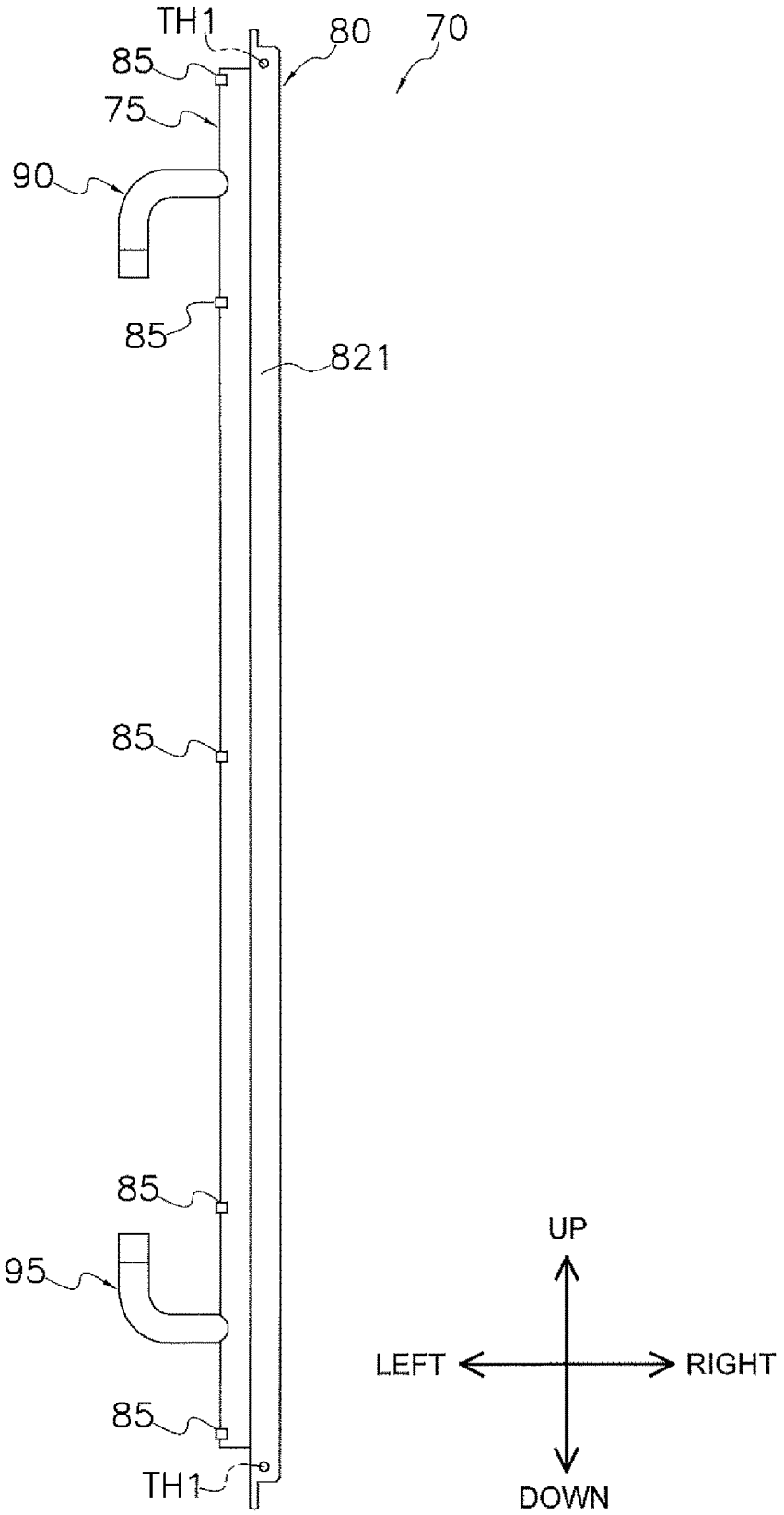
FIG. 13 is a rear view of the header collecting tube in accordance with one or more embodiments.

FIG. 11 is an enlarged view of area XI in FIG. 4. FIG. 12 is a left side view of the header collecting tube 70. FIG. 13 is a rear view of the header collecting tube 70.

The header collecting tube 70 is located in the machine chamber SP2 in the unit casing 40. The longitudinal direction of the header collecting tube 70 extends in the up-down direction. The header collecting tube 70 is a tube through which the refrigerant flows into and out from the heat transfer tubes 60, and functions as a diverting header or a fold-back header of the refrigerant.

In one or more embodiments, the header collecting tube 70 is constituted by combining a plurality of members manufactured by extrusion molding or machining. The header collecting tube 70 mainly includes a header body portion 75, a plate member 80, a horizontal partition plate 85, a gas-side connection pipe 90, and a liquid-side connection pipe 95.

(5-1) Header Body Portion 75

Figure 14:
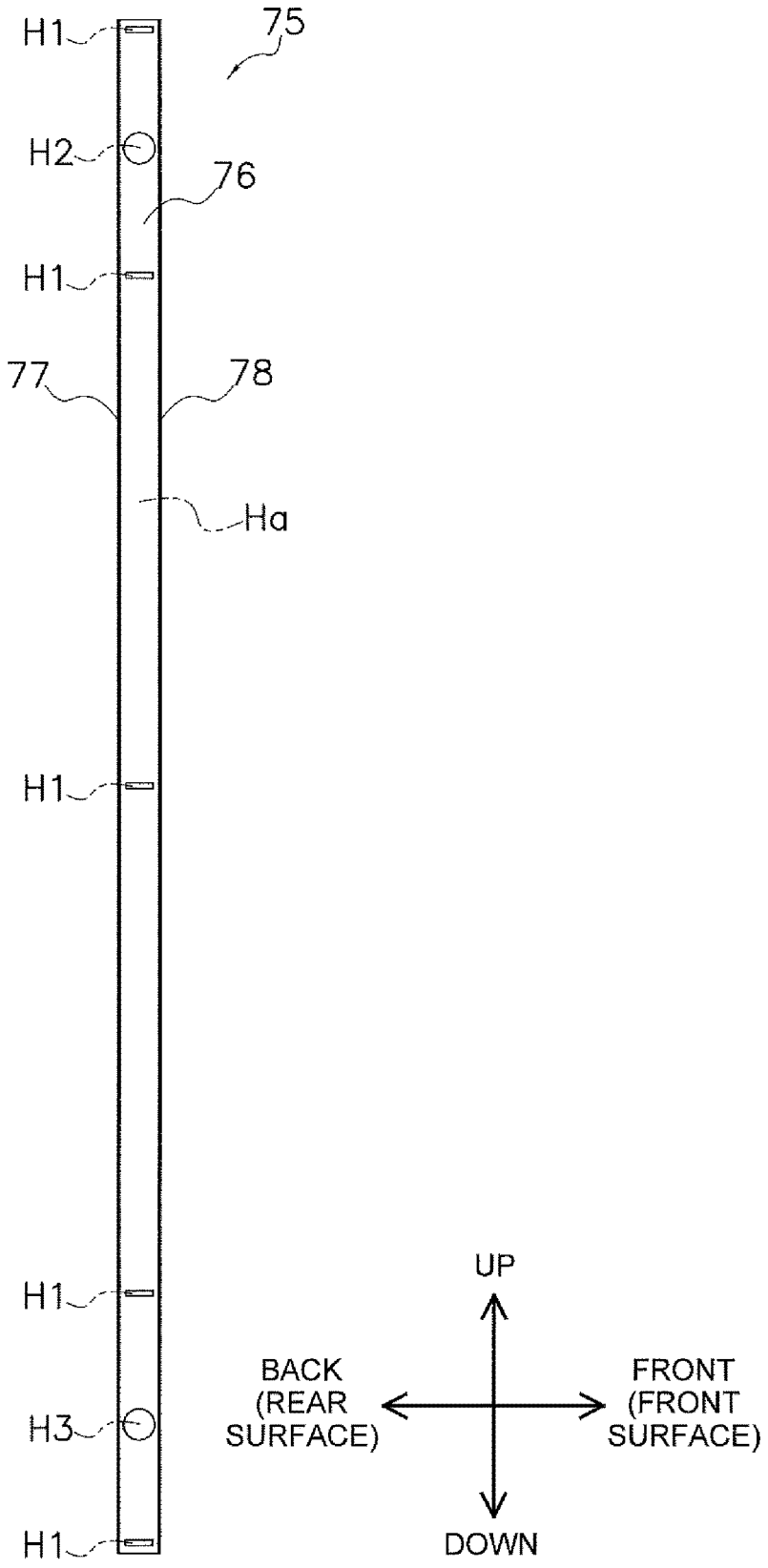
FIG. 14 is a right side view of a header body portion in accordance with one or more embodiments.
Figure 15:
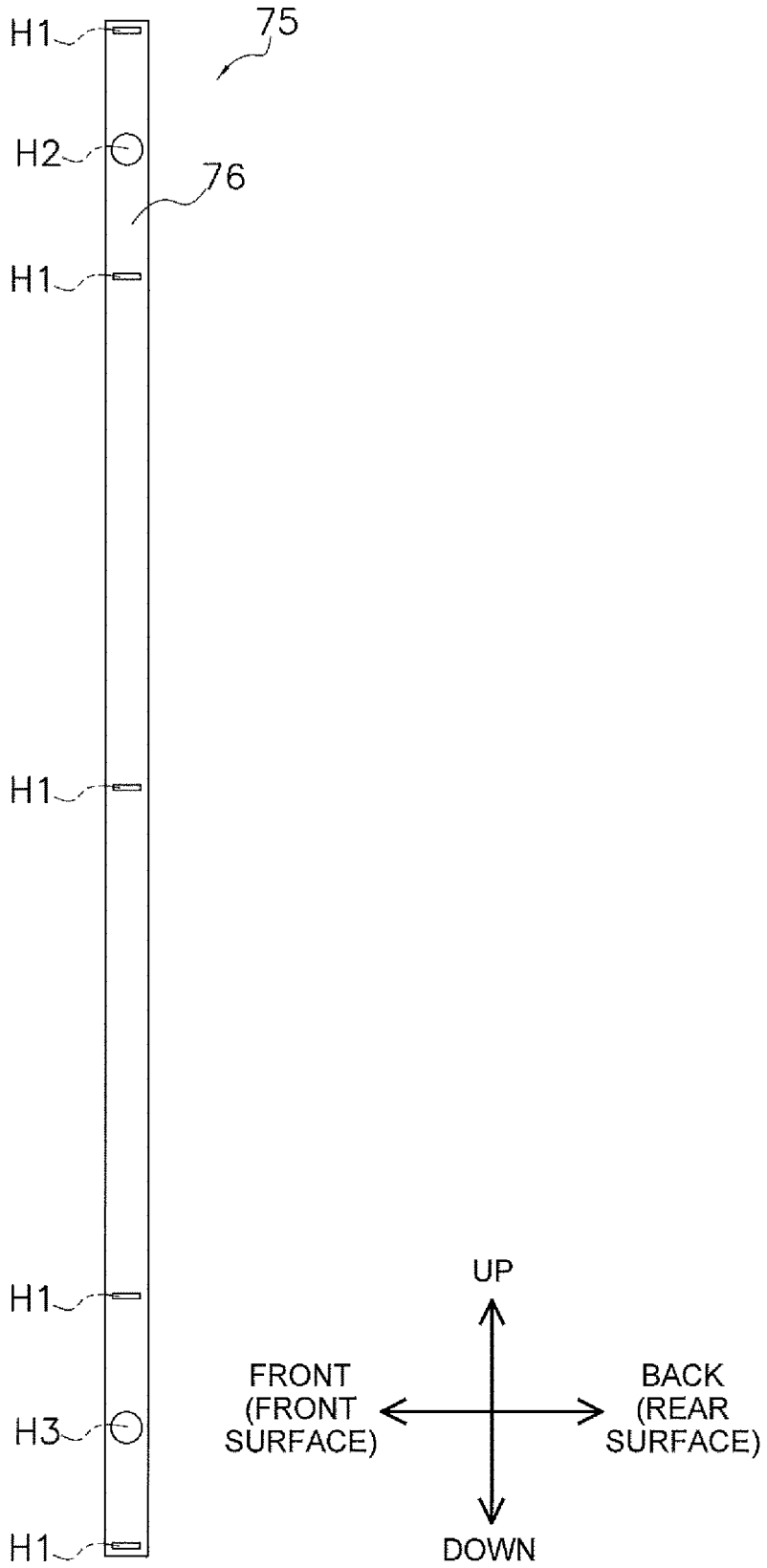
FIG. 15 is a left side view of the header body portion in accordance with one or more embodiments.
Figure 16:
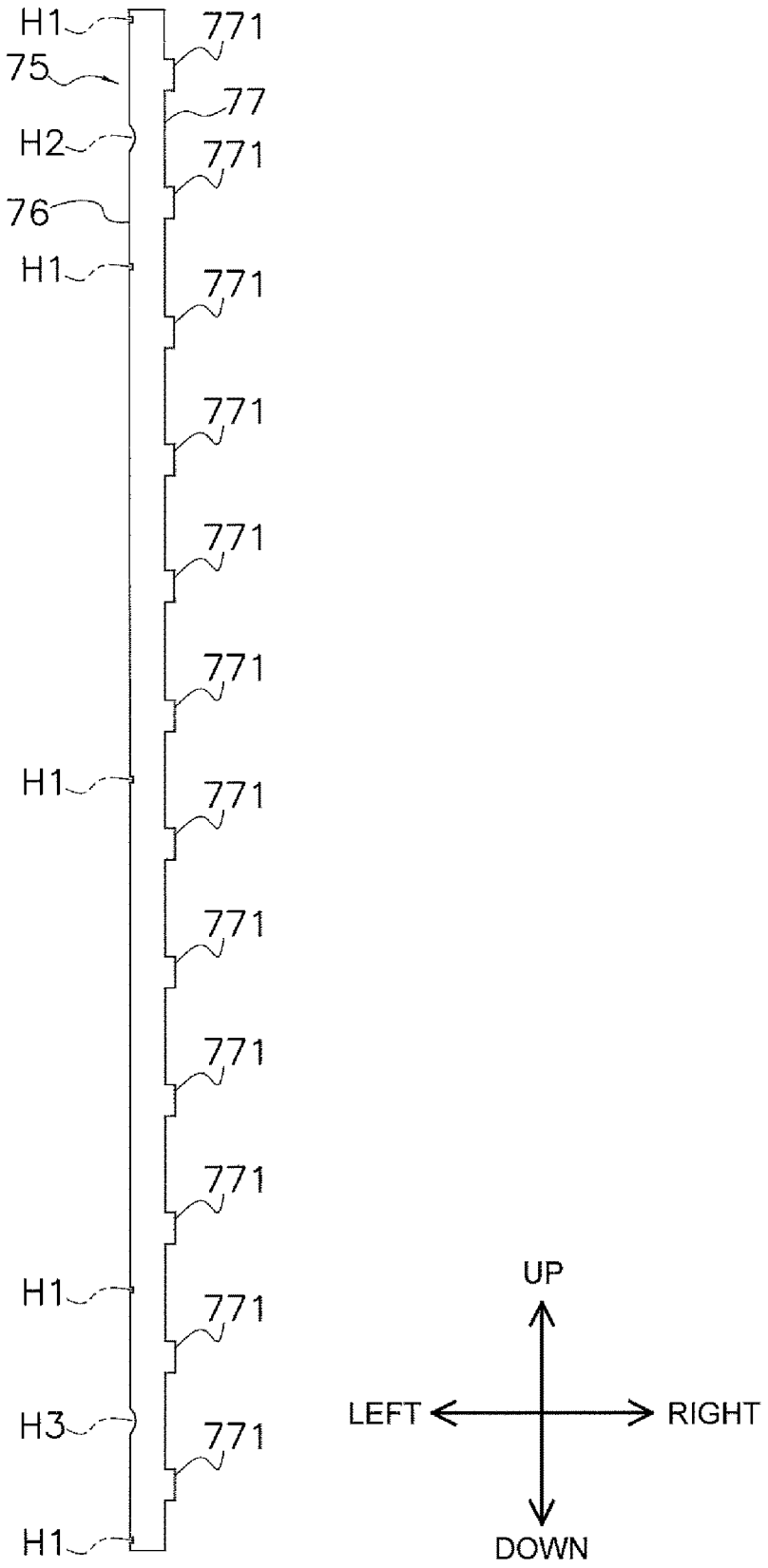
FIG. 16 is a rear view of the header body portion in accordance with one or more embodiments.
Figure 17:
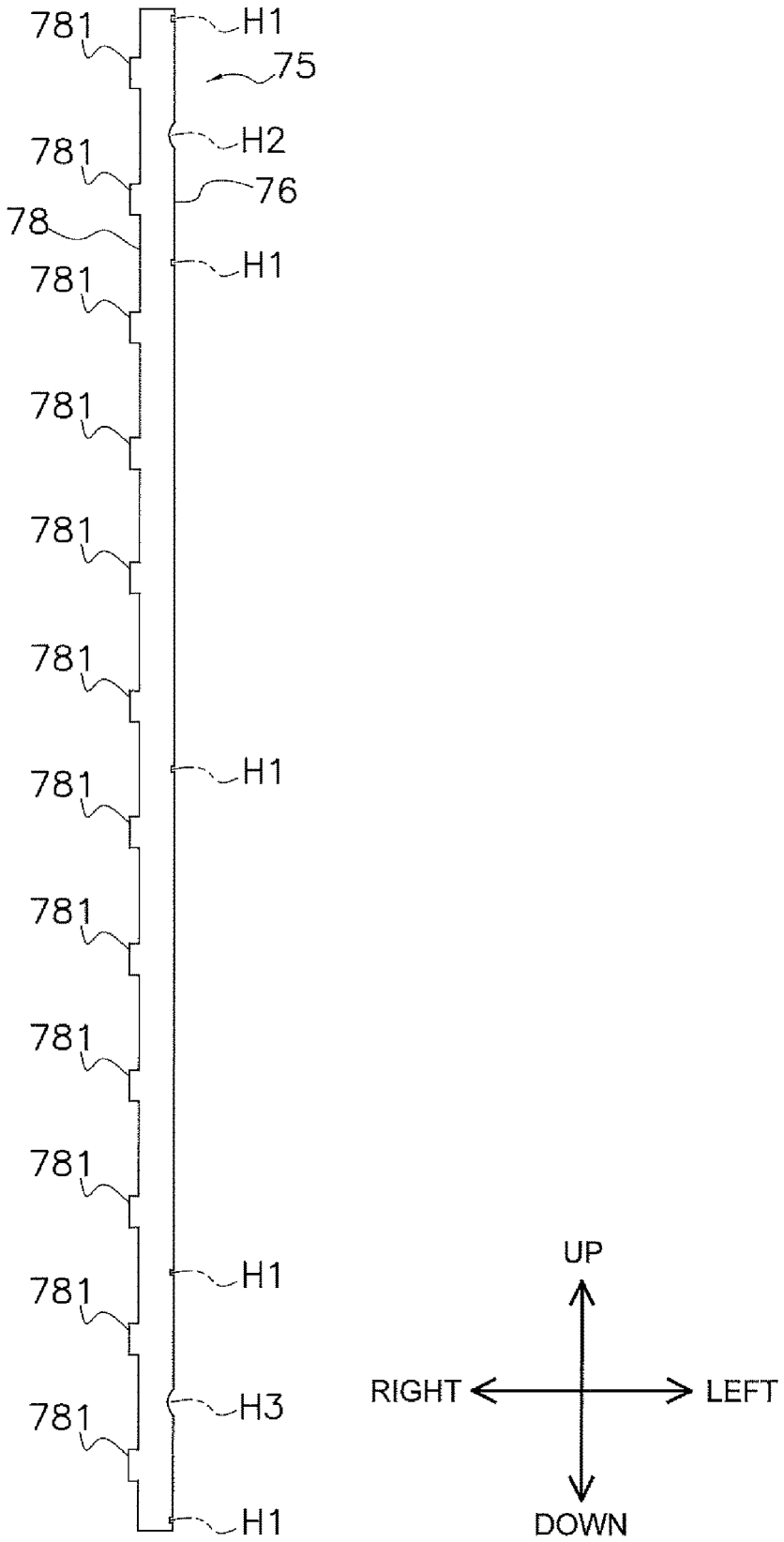
FIG. 17 is a front view of the header body portion in accordance with one or more embodiments.
Figure 18:
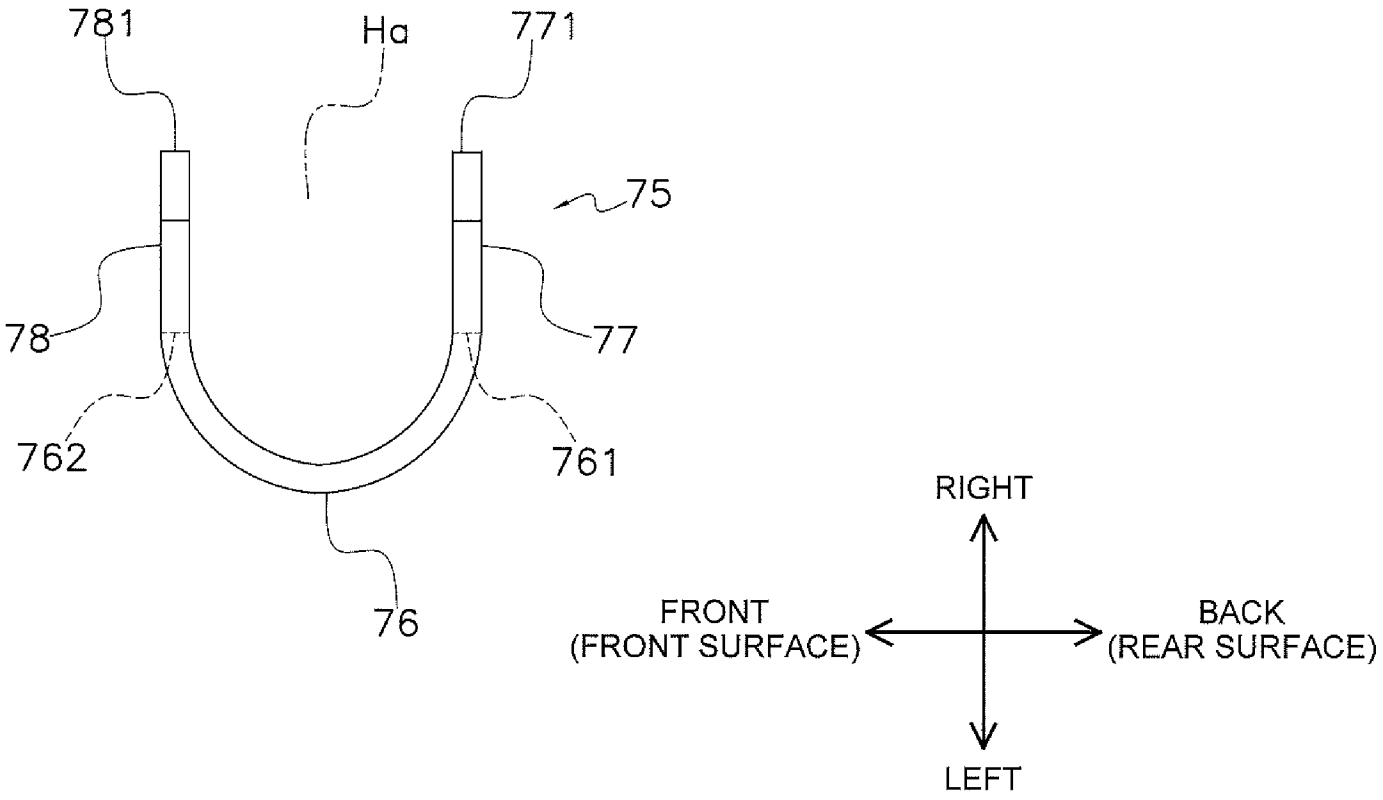
FIG. 18 is a plan view of the header body portion in accordance with one or more embodiments.

FIG. 14 is a right side view of the header body portion 75. FIG. 15 is a left side view of the header body portion 75. FIG. 16 is a rear view of the header body portion 75. FIG. 17 is a front view of the header body portion 75. FIG. 18 is a plan view of the header body portion 75.

The header body portion 75 is a member that constitutes a major part of the header collecting tube 70. The header body portion 75 is a semi-cylindrical member made of aluminum or an aluminum alloy and extending along the up-down direction (that is, the longitudinal direction of the header collecting tube 70). The header body portion 75 has a substantially U-like cross section in the horizontal direction (the transverse direction). That is, the header body portion 75 is open in a predetermined direction (in this case, the right side) in the cross section in the transverse direction. The header body portion 75 has an opening Ha (see FIG. 18).

The header body portion 75 includes a body first portion 76, a body second portion 77, and a body third portion 78. The body first portion 76, the body second portion 77, and the body third portion 78 are described in a divided manner for the convenience of explanation although the body first portion 76 to the body third portions 78 continuously extend and are integrally formed.

(5-1-1) Body First Portion 76

The body first portion 76 is a portion disposed on the left side in the installed state, and is a portion that is curved to protrude to the left side in plan view. The body first portion 76 has a substantially U-like shape in plan view. The longitudinal direction of the body first portion 76 extends from the upper end to the lower end of the header body portion 75.

The body first portion 76 has a plurality of (the number being equivalent to the number of the horizontal partition plates 85 disposed at the header collecting tube 70, in this case, five) body-portion partition-plate insertion holes H1 into which the horizontal partition plates 85 are inserted. The body-portion partition-plate insertion holes H1 are arranged in the up-down direction so that the horizontal partition plates 85 are properly disposed in accordance with the positions of the spaces (S1 to S4) formed in the header collecting tube 70. Edge portions of the body-portion partition-plate insertion holes H1 are made of a brazing alloy, and thus are joined by brazing to the inserted horizontal partition plates 85.

In addition, the body first portion 76 has a gas-side connection-pipe insertion hole H2 into which the gas-side connection pipe 90 is inserted. The gas-side connection-pipe insertion hole H2 is formed at a position corresponding to the position of the gas-side connection pipe 90 (in one or more embodiments, a position corresponding to the first header inner space S1). An edge portion of the gas-side connection-pipe insertion hole H2 is made of a brazing alloy, and thus is joined by brazing to the gas-side connection pipe 90 so that a gap is completely closed.

In addition, the body first portion 76 has a liquid-side connection-pipe insertion hole H3 into which the liquid-side connection pipe 95 is inserted. The liquid-side connection-pipe insertion hole H3 is formed at a position corresponding to the position of the liquid-side connection pipe 95 (in one or more embodiments, a position corresponding to the fourth header inner space S4). An edge portion of the liquid-side connection-pipe insertion hole H3 is made of a brazing alloy, and thus is joined by brazing to the liquid-side connection pipe 95 so that a gap is completely closed.

(5-1-2) Body Second Portion 77

The body second portion 77 is a portion disposed on the rear-surface side in the installed state. The body second portion 77 is a plate-shaped portion that linearly extends in the left-right direction in plan view. The longitudinal direction of the body second portion 77 extends from the upper end to the lower end of the header body portion 75. The end portion of the body second portion 77 on the left side is connected to an end portion 761 (see FIG. 18) of the body first portion 76 on the rear-surface side.

The body second portion 77 has a plurality of first ribs 771 (corresponding to "protrusion" described in the claims) provided at the end portion on the right side thereof and extending in the left-right direction (see FIGS. 16 and 18). At the body second portion 77, the plurality of (in this case, twelve) first ribs 771 are spaced apart in the up-down direction. The first ribs 771 are provided for a plurality of first rib insertion holes H4 (see FIGS. 19 and 20) formed at the plate member 80, in a one-to-one correspondence. Each of the first ribs 771 extends in the up-down direction, and has a dimension by which the first rib 771 is engaged with the corresponding first rib insertion hole H4 (see FIGS. 19 and 20). Each of the first ribs 771 is inserted into and engaged with the corresponding first rib insertion hole H4. In other words, at the body second portion 77, the plurality of first ribs 771 formed in predetermined shapes are disposed at predetermined positions so that the first ribs 771 are inserted into and engaged with all the plurality of first rib insertion holes H4 formed at the plate member 80. Each of the first ribs 771 is joined at an edge portion of the corresponding first rib insertion hole H4. In one or more embodiments, the body second portion 77 is joined by brazing to the plate member 80 to completely close the first rib insertion holes H4 into which the first ribs 771 have been inserted. That is, each of the first ribs 771 is engaged with the first rib insertion hole H4 in the state in which the header body portion 75 and the plate member 80 are fixed.

(5-1-3) Body Third Portion 78

The body third portion 78 is a portion disposed on the front-surface side in the installed state. The body third portion 78 is a plate-shaped portion that linearly extends in the left-right direction in plan view. The longitudinal direction of the body third portion 78 extends from the upper end to the lower end of the header body portion 75. The body third portion 78 is disposed to face the body second portion 77. The end portion of the body third portion 78 on the left side is connected to an end portion 762 (see FIG. 18) of the body first portion 76 on the front-surface side.

The body third portion 78 has a plurality of second ribs 781 (corresponding to "protrusion" described in the claims) provided at the end portion on the left side thereof and extending in the left-right direction (see FIGS. 17 and 18). At the body third portion 78, the plurality of (in this case, twelve) second ribs 781 are spaced apart in the up-down direction. The second ribs 781 are provided for a plurality of second rib insertion holes H5 (see FIGS. 19 and 20) formed at the plate member 80, in a one-to-one correspondence. Each of the second ribs 781 extends in the up-down direction, and has a dimension by which the second rib 781 is engaged with the corresponding second rib insertion hole H5 (see FIGS. 19 and 20). Each of the second ribs 781 is inserted into and engaged with the corresponding second rib insertion hole H5. In other words, at the body third portion 78, the plurality of second ribs 781 formed in predetermined shapes are disposed at predetermined positions so that the second ribs 781 are inserted into and engaged with all the plurality of second rib insertion holes H5 formed at the plate member 80. Each of the second ribs 781 is joined to the plate member 80 at an edge portion of the corresponding second rib insertion hole H5. In one or more embodiments, the body third portion 78 is joined by brazing to the plate member 80 to completely close the second rib insertion holes H5 into which the second ribs 781 have been inserted. That is, each of the second ribs 781 is engaged with the corresponding second rib insertion hole H5 in the state in which the header body portion 75 and the plate member 80 are fixed.

(5-2) Plate Member 80

Figure 19:
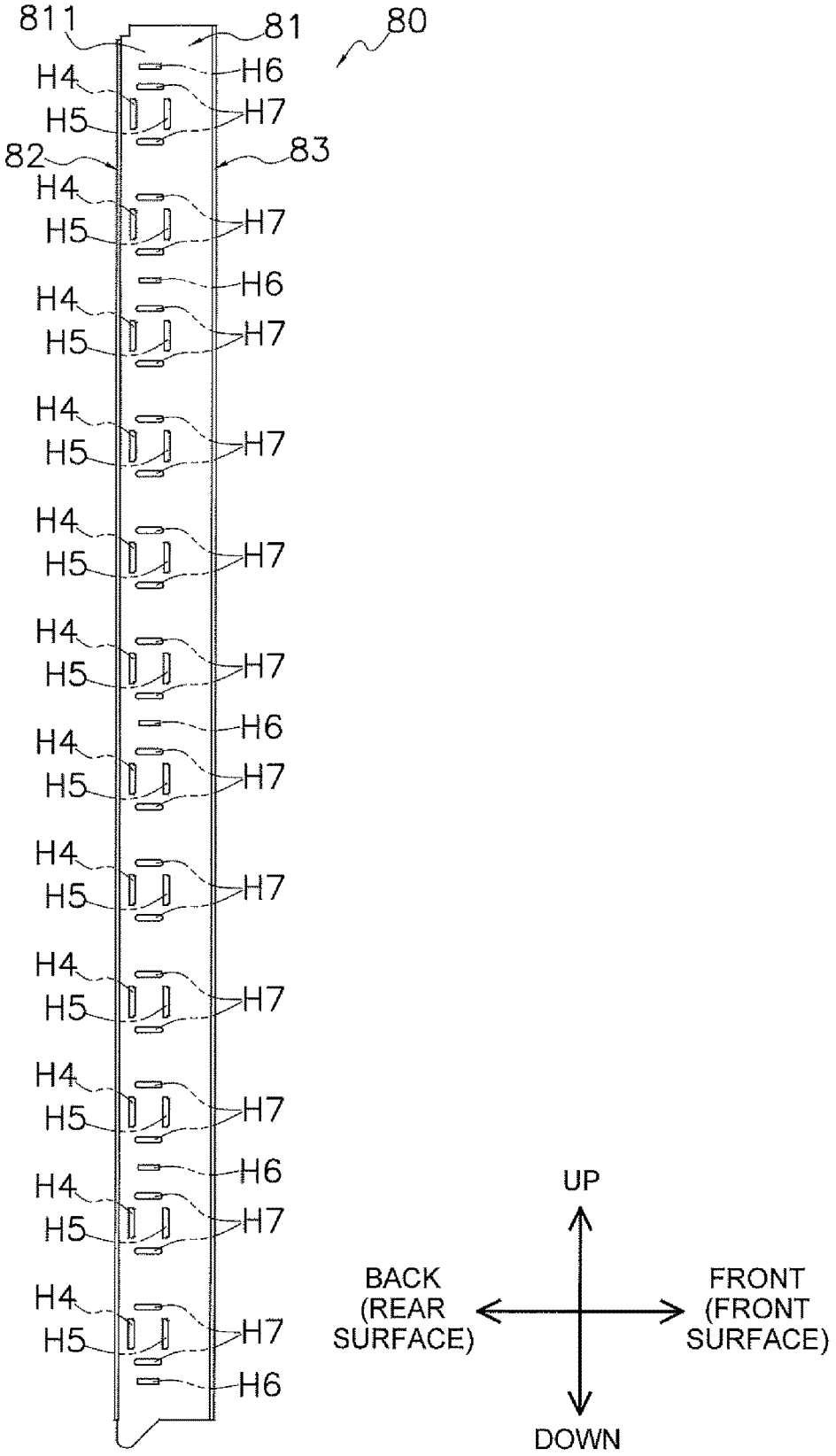
FIG. 19 is a right side view of a plate member in accordance with one or more embodiments.
Figure 20:
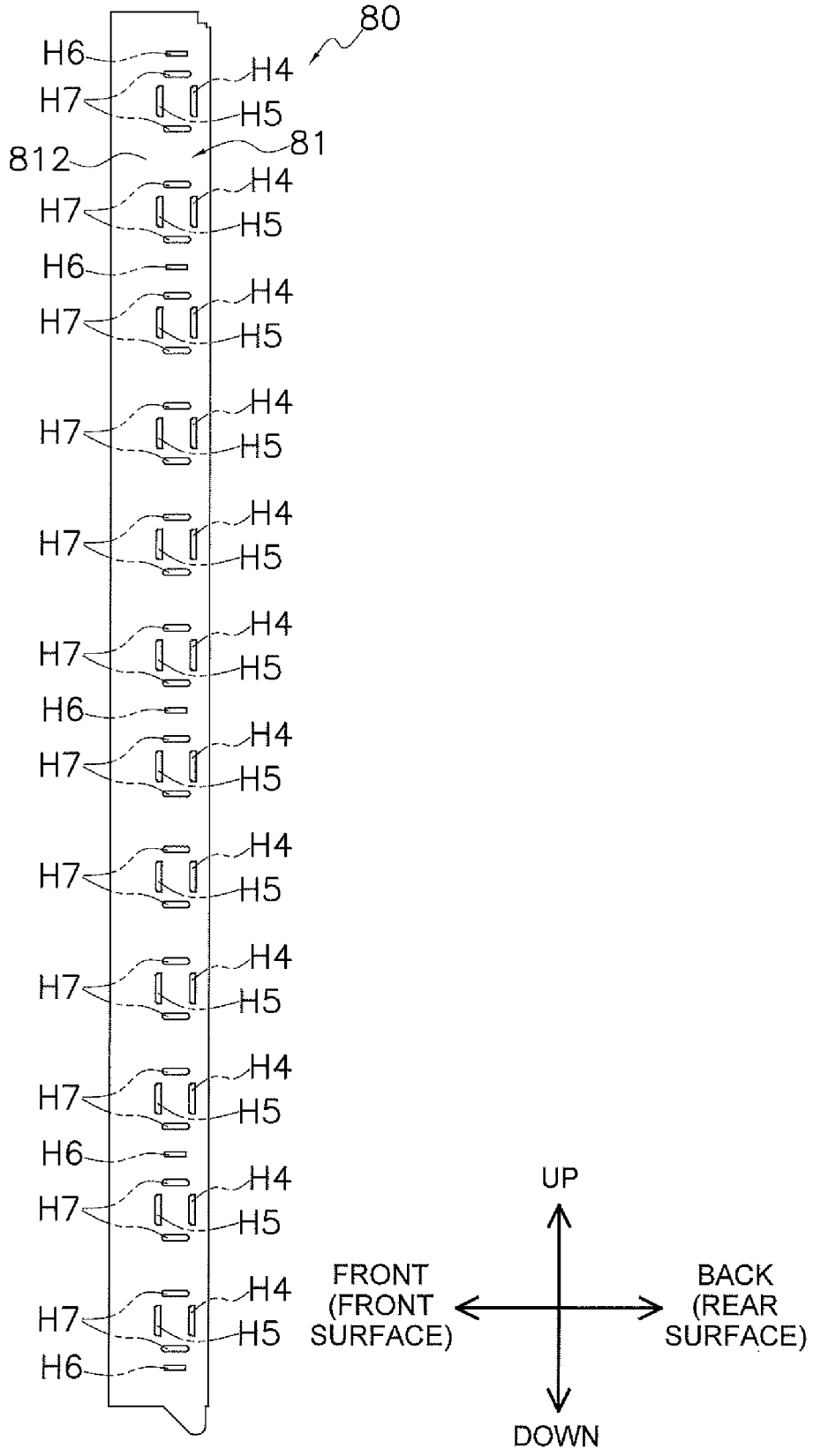
FIG. 20 is a left side view of the plate member in accordance with one or more embodiments.
Figure 21:
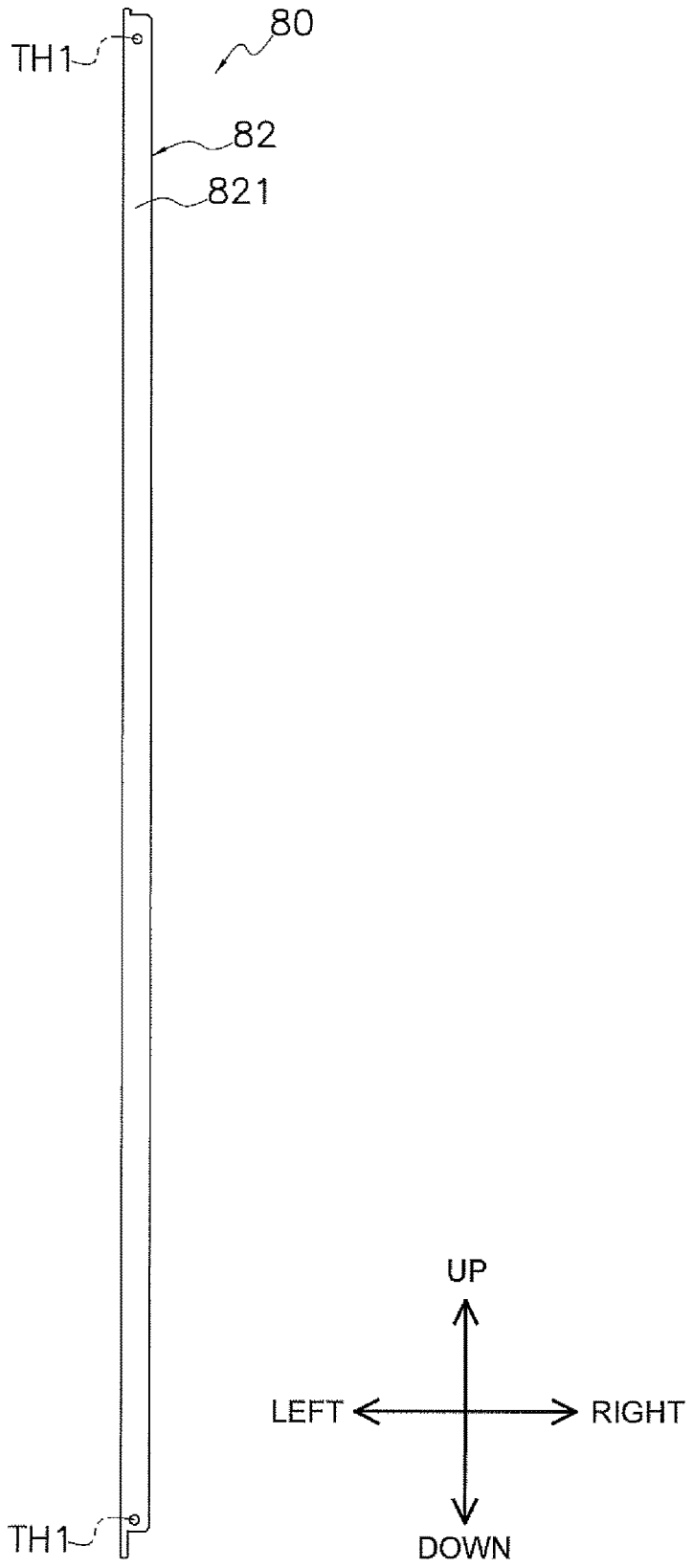
FIG. 21 is a rear view of the plate member in accordance with one or more embodiments.
Figure 22:
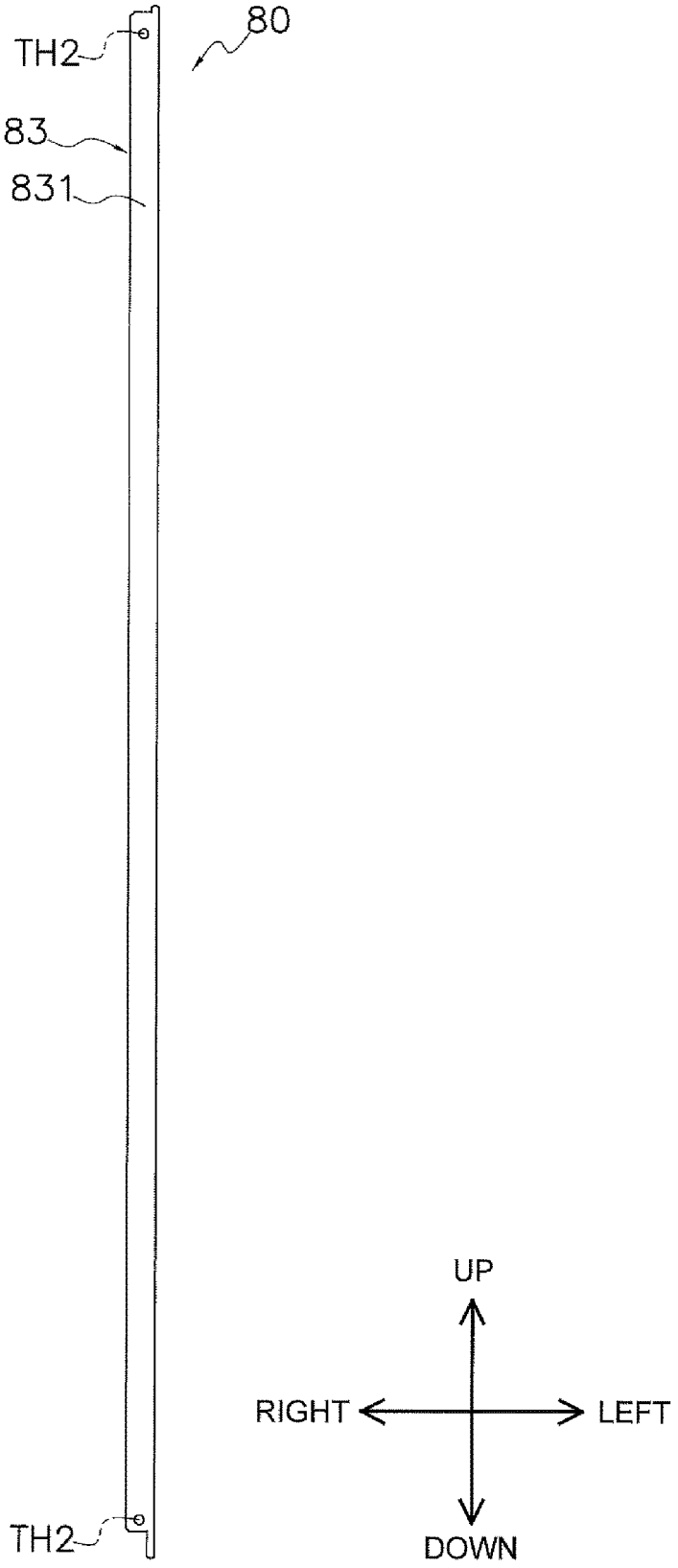
FIG. 22 is a front view of the plate member in accordance with one or more embodiments.
Figure 23:
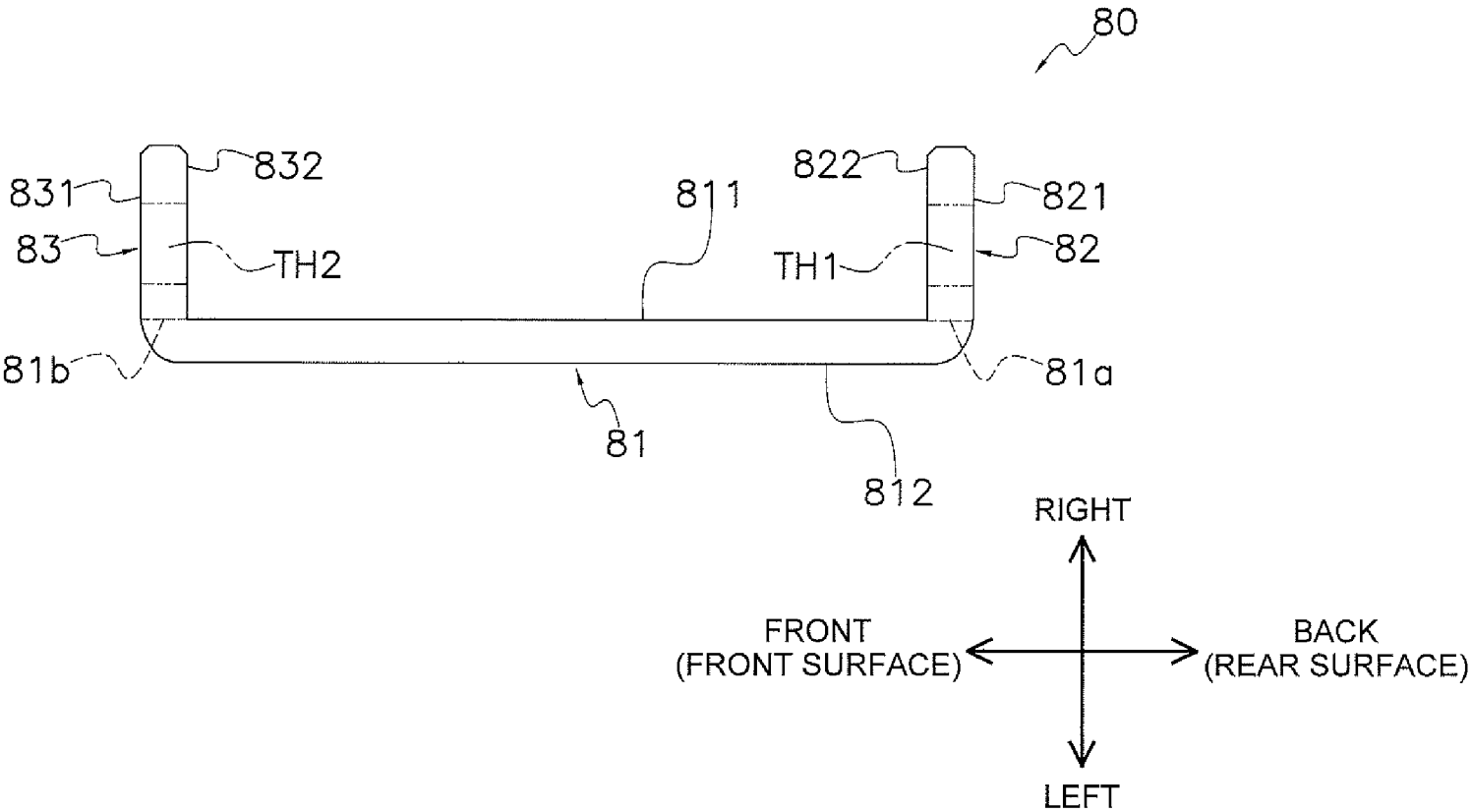
FIG. 23 is a plan view of the plate member in accordance with one or more embodiments.

FIG. 19 is a right side view of the plate member 80. FIG. 20 is a left side view of the plate member 80. FIG. 21 is a rear view of the plate member 80. FIG. 22 is a front view of the plate member 80. FIG. 23 is a plan view of the plate member 80.

The plate member 80 is a plate-shaped member made of aluminum or an aluminum alloy. More specifically, the plate member 80 is constituted of a three-layer clad material including a brazing material, a core material, and a sacrificial material.

The plate member 80 is a member that constitutes a surface (in this case, a surface on the right side) of the header collecting tube 70 and that forms the spaces (S1 to S4) in the header collecting tube 70 together with the header body portion 75. In addition, the plate member 80 functions as a tube plate that supports the end portions of the heat transfer tubes 60. Moreover, the plate member 80 also functions as a fixing member that is fixed to the unit casing 40 or another member and hence that fixes the header collecting tube 70 (or the outdoor heat exchanger 15). Furthermore, the plate member 80 functions as a wind shielding plate that shields the machine chamber SP2 from the outdoor air flow AF.

The plate member 80 is joined by brazing to the header body portion 75. More specifically, the plate member 80 is joined to the header body portion 75 to cover the opening Ha of the header body portion 75 from the right side. The plate member 80 forms header inner spaces (S1 to S4) together with the header body portion 75.

The plate member 80 includes a first plate portion 81, a second plate portion 82, and a third plate portion 83. The first plate portion 81, the second plate portion 82, and the third plate portion 83 are described in a divided manner for the convenience of explanation although the first to third plate portions 81 to 83 continuously extend and are integrally formed.

(5-2-1) First Plate Portion 81

The first plate portion 81 is a portion that constitutes a right-side surface of the header collecting tube 70 (the surface on the side of the heat exchange portions 50). The first plate portion 81 has a plate-like shape extending in the front-rear direction in plan view.

The longitudinal direction of the first plate portion 81 extends from the upper end to the lower end of the plate member 80.

The first plate portion 81 includes a front surface 811 that is a main surface facing the fan chamber SP1 (in this case, the right side). The first plate portion 81 includes a rear surface 812 that is a main surface facing the machine chamber SP2 (in this case, the left side). The dimensions of the front surface 811 and the rear surface 812 in the front-rear direction (that is, a direction intersecting with a direction in which the heat transfer tubes 60 of the first heat exchange portion 51 extend) are larger than the dimension of the header body portion 75 in the front-rear direction (in this case, two times larger). In addition, the lengths of the front surface 811 and the rear surface 812 in the up-down direction (the longitudinal direction) are larger than the length of the header body portion 75 in the up-down direction.

In this case, the front surface 811 of the first plate portion 81 shields the machine chamber SP2 (the devices disposed in the machine chamber SP2) from the outdoor air flow AF. That is, the front surface 811 corresponds to "a wind shielding surface" that shields, for example, the header body portion 75, the gas-side connection pipe 90, and the liquid side connection pipe 95 from the outdoor air flow AF. The front surface 811 shields the area from the one end to the other end of the header body portion 75 in the longitudinal direction (in this case, the up-down direction), from the outdoor air flow AF.

The first plate portion 81 including the front surface 811 is a component member of the header collecting tube 70 and functions as a wind shielding plate. That is, the first plate portion 81 serves as a wind shielding plate that is integrally formed with the header collecting tube 70.

In another viewpoint, the plate member 80 includes a wind shielding plate that is fixed to the header collecting tube 70. That is, when the plate member 80 is interpreted as "a wind shielding plate" that shields the machine chamber SP2 from the outdoor air flow AF, it can be interpreted that the wind shielding plate (the plate member 80) is fixed to the header collecting tube 70.

The first plate portion 81 has a plurality of openings. Specifically, the first plate portion 81 has a plurality of (the number being equivalent to the number of the first ribs 771 provided at the header body portion 75) first rib insertion holes H4 (corresponding to "engagement hole" described in the claims) into which the first ribs 771 are inserted. The first rib insertion holes H4 are formed in accordance with the shapes of the first ribs 771. In one or more embodiments, the longitudinal direction of the first rib insertion holes H4 is along the up-down direction.

In addition, the first plate portion 81 has a plurality of (the number being equivalent to the number of the second ribs 781 provided at the header body portion 75) second rib insertion holes H5 (corresponding to "engagement hole" described in the claims) into which the second ribs 781 are inserted. The second rib insertion holes H5 are formed in accordance with the shapes of the second ribs 781. In one or more embodiments, the longitudinal direction of the second rib insertion holes H5 is along the up-down direction.

The first rib insertion holes H4 and the second rib insertion holes H5 are arranged in the horizontal direction at positions below or above heat-transfer-tube insertion holes H7 (described later). More specifically, each of the first rib insertion holes H4 and each of the second rib insertion holes H5 are formed between a pair of upper and lower heat transfer tube insertion holes H7.

Edge portions of the first rib insertion holes H4 and the second rib insertion holes H5 are made of a brazing alloy, and thus are joined by brazing to the inserted first ribs 771 or second ribs 781. That is, a portion of the first plate portion 81 that comes into contact with the header body portion 75 (the header collecting tube 70) is made of a brazing alloy.

The first plate portion 81 has a plurality of (the number being equivalent to the number of the horizontal partition plates 85 disposed at the header collecting tube 70, in this case, five) partition-plate insertion holes H6 into which the horizontal partition plates 85 are inserted. The partition-plate insertion holes H6 are arranged in the up-down direction so that the horizontal partition plates 85 are properly disposed in accordance with the positions of the spaces (S1 to S4) formed in the header collecting tube 70. Edge portions of the partition-plate insertion holes H6 are made of a brazing alloy, and thus are joined by brazing to the inserted horizontal partition plates 85.

In addition, the first plate portion 81 has heat-transfer-tube insertion holes H7 (corresponding to "insertion hole" described in the claims) provided for the heat transfer tubes 60 (60*a* to 60*l*) in a one-to-one correspondence and into which one ends or the other ends of the corresponding heat transfer tubes 60 are inserted. The first plate portion 81 has the same number of the heat-transfer-tube insertion holes H7 (the number being twenty-four) as the number of the one ends and the other ends of the heat transfer tubes 60. The heat-transfer-tube insertion holes H7 are disposed at the positions (in this case, the height positions) of the heat transfer tubes 60 to be inserted. Edge portions of the heat-transfer-tube insertion holes H7 are made of a brazing alloy, and thus the first plate portion 81 is joined by brazing to the heat transfer tubes 60 in the state in which the heat transfer tubes 60 are inserted into the heat-transfer-tube insertion holes H7. By inserting the heat transfer tubes 60 into the first plate portion 81 and joining the heat transfer tubes 60 to the first plate portion 81 according to one or more embodiments, the plate member 80 functions as a tube plate that supports the end portions of the heat transfer tubes 60.

(5-2-2) Second Plate Portion 82

The second plate portion 82 is a portion disposed on the rear-surface side in the installed state. The second plate portion 82 is a plate-shaped portion that linearly extends in the left-right direction in plan view. The longitudinal direction of the second plate portion 82 extends from the upper end to the lower end of the plate member 80. The end portion of the second plate portion 82 on the left side is connected to a rear end portion 81*a* (see FIG. 23) of the first plate portion 81.

Screw holes TH1 are formed near the upper end and the lower end of the second plate portion 82. The second plate portion 82 is screwed and fixed to the unit casing 40 via the screw holes TH1. In one or more embodiments, the second plate portion 82 is screwed and fixed to the rear-surface portion of the left-side panel 44 and a rising portion 411 of the bottom plate 41 by screws SC (see FIG. 11). In other words, the plate member 80 is fixed to the unit casing 40 at the second plate portion 82. That is, the plate member 80 including the second plate portion 82 corresponds to "a fixing member" for fixing the header collecting tube 70 (the outdoor heat exchanger 15) to a predetermined member.

The second plate portion 82 includes a second-plate-portion back surface 821 that is a main surface facing the rear-surface side (that is, the side of the unit casing 40 to which the second plate portion 82 is screwed and fixed), and a second-plate-portion front surface 822 that is a main surface facing the front-surface side (see FIG. 23). The second-plate-portion back surface 821 is a portion that comes into contact with the unit casing 40 (the bottom plate 41 or the left-side panel 44), and is made of a sacrificial material. Thus, the core material of the plate member 80 is protected from galvanic corrosion by the sacrificial material at the contact portion with respect to the unit casing 40, thereby suppressing corrosion.

(5-2-3) Third Plate Portion 83

The third plate portion 83 is a portion disposed on the front-surface side in the installed state. The third plate portion 83 is a plate-shaped portion that linearly extends in the left-right direction in plan view. The longitudinal direction of the third plate portion 83 extends from the upper end to the lower end of the plate member 80. The end portion of the third plate portion 83 on the left side is connected to a front end portion 81*b* (see FIG. 23) of the first plate portion 81.

Screw holes TH2 are formed near the upper end and the lower end of the third plate portion 83. The third plate portion 83 is screwed and fixed to the unit casing 40 via the screw holes TH2. In one or more embodiments, the third plate portion 83 is screwed and fixed by screws SC (see FIG. 11). In other words, the plate member 80 is fixed to a member (the partition plate 46) disposed at the unit casing 40 at the third plate portion 83. That is, the plate member 80 including the third plate portion 83 corresponds to "a fixing member" for fixing the header collecting tube 70 (the outdoor heat exchanger 15) to a predetermined member.

The third plate portion 83 includes a third-plate-portion back surface 831 that is a main surface facing the front-surface side (that is, the side of the partition plate 46 to which the third plate portion 83 is screwed and fixed), and a third-plate-portion front surface 832 that is a main surface facing the rear-surface side (see FIG. 23). The third-plate-portion back surface 831 is a portion that comes into contact with the partition plate 46, and is made of a sacrificial material. Thus, the core material of the plate member 80 is protected from galvanic corrosion by the sacrificial material at the contact portion with respect to the partition plate 46, thereby suppressing corrosion.

(5-3) Horizontal Partition Plate 85

Figure 24:
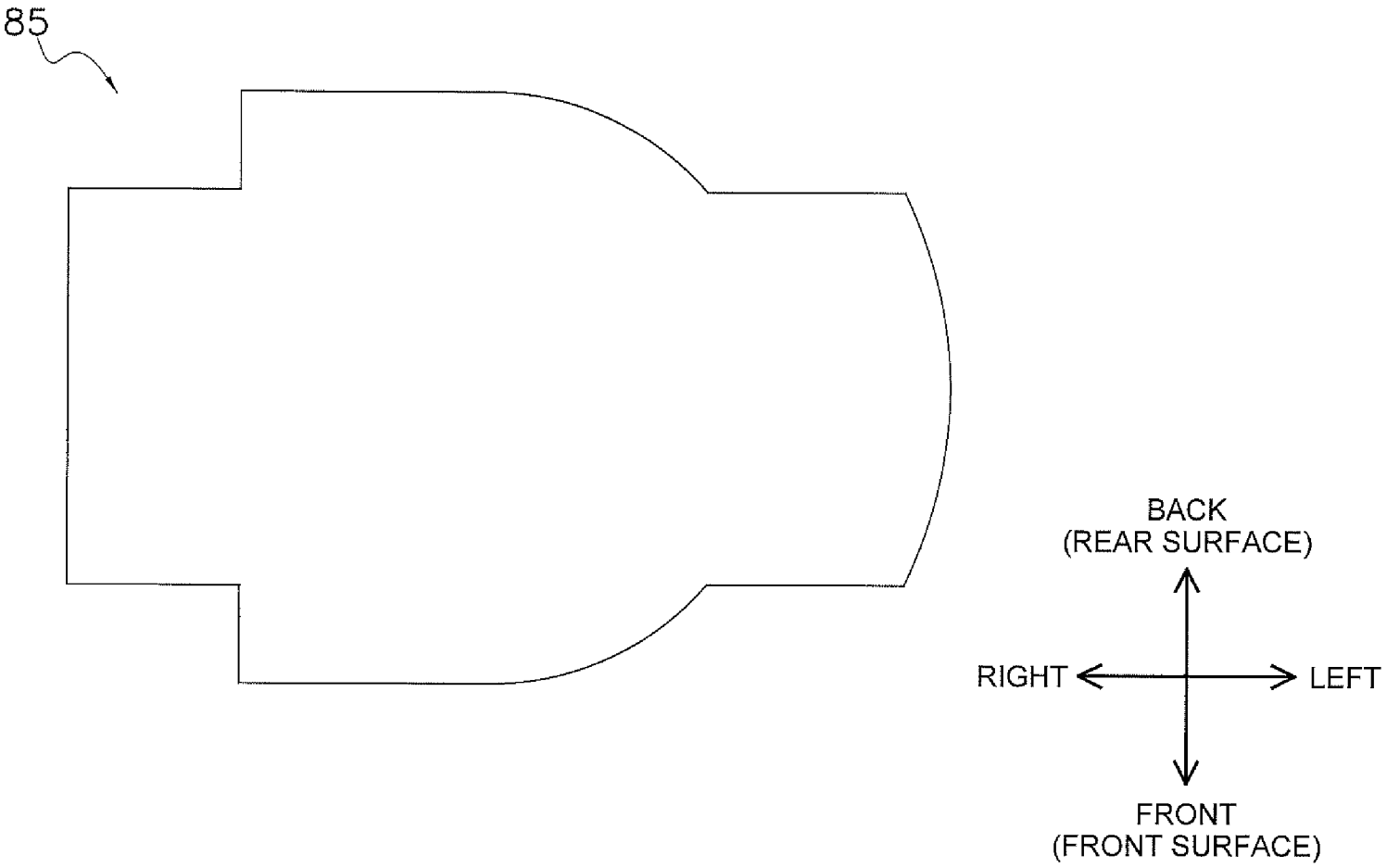
FIG. 24 is a plan view of a horizontal partition plate in accordance with one or more embodiments.

FIG. 24 is a plan view of the horizontal partition plate 85. The horizontal partition plate 85 is a member that extends in the horizontal direction (a direction intersecting with the longitudinal direction of the header collecting tube 70) in the header collecting tube 70, and that partitions the space into upper and lower sections. The horizontal partition plate 85 has an area corresponding to the cross-sectional area of the header collecting tube 70. The horizontal partition plate 85 is inserted into the body-portion partition-plate insertion hole H1 of the header body portion 75 and the partition-plate insertion hole H6 of the plate member 80; and is joined to the header body portion 75 and the plate member 80 at the edge portions of the body-portion partition-plate insertion hole H1 and the partition-plate insertion hole H6. More specifically, the horizontal partition plate 85, the header body portion 75, and the plate member 80 are joined by brazing to one another to completely close the body-portion partition-plate insertion hole H1 and the partition-plate insertion hole H6.

In one or more embodiments, as described above, since the plurality of (in this case, six) horizontal partition plates 85 are disposed to be spaced apart in the up-down direction, the first header inner space S1, the second header inner space S2, the third header inner space S3, and the fourth header inner space S4 are formed in the header collecting tube 70.

In one or more embodiments, the horizontal partition plate 85 disposed at the uppermost position constitutes the top-surface portion of the header collecting tube 70. In addition, the horizontal partition plate 85 disposed at the lowermost position constitutes the bottom-surface portion of the header collecting tube 70.

(5-4) Gas-Side Connection Pipe 90, Liquid-Side Connection Pipe 95

The gas-side connection pipe 90 and the liquid-side connection pipe 95 are made of aluminum or an aluminum alloy. The pipe diameters and the pipe lengths of the gas-side connection pipe 90 and the liquid-side connection pipe 95 are individually selected in accordance with design specification and installation environment. The gas-side connection pipe 90 and the liquid-side connection pipe 95 are connected to the refrigerant pipe made of copper and provided in the outdoor unit 10 (the fourth pipe P4 and the fifth pipe P5). That is, the gas-side connection pipe 90 and the liquid-side connection pipe 95 are connected to other pipes made of a different kind of metal.

The gas-side connection pipe 90 is disposed near the upper end of the header collecting tube 70. The gas-side connection pipe 90 has the gas-side inlet/outlet 151 at one end thereof, and communicates with the first header inner space S1 at the other end thereof. The gas-side connection pipe 90 is connected to the fourth pipe P4 at the one end thereof. The gas-side connection pipe 90 is joined by brazing to the gas-side connection-pipe insertion hole H2 of the header body portion 75 at the other end thereof. A connection portion J1 (see FIG. 5) of the gas-side connection pipe 90 and the fourth pipe SP4 is disposed in the machine chamber SP2.

The liquid-side connection pipe 95 is disposed near the lower end of the header collecting tube 70. The liquid-side connection pipe 95 has the liquid-side inlet/outlet 152 at one end thereof, and communicates with the fourth header inner space S4 at the other end thereof. The liquid-side connection pipe 95 is connected to the fifth pipe P5 at the one end thereof. The liquid-side connection pipe 95 is joined by brazing to the liquid-side connection-pipe insertion hole H3 of the header body portion 75 at the other end thereof. A connection portion J2 (see FIG. 5) of the liquid-side connection pipe 95 and the fifth pipe SP5 is disposed in the machine chamber SP2.

(6) Method of Assembling Outdoor Heat Exchanger 15

The outdoor heat exchanger 15 is assembled by the following steps. It is to be noted that the following steps are merely an example, and can be properly modified.

A first step of assembling (temporarily assembling) the header collecting tube 70 is performed first. In the first step, by using a jig, the first ribs 771 and the second ribs 781 of the header body portion 75 are inserted into the corresponding first rib insertion holes H4 or the corresponding second rib insertion holes H5 of the plate member 80, and are engaged with the edge portions of the inserted holes. Thus, the header body portion 75 and the plate member 80 are temporarily assembled.

In addition, at this time, the one ends of the horizontal partition plates 85 are inserted into the body-portion partition-plate insertion holes H1 of the header body portion 75, the other ends of the horizontal partition plates 85 are inserted into the partition-plate insertion holes H6 of the plate member 80, and the one ends and the other ends are engaged with the edge portions of the inserted holes so that the horizontal partition plates 85 are interposed between the header body portion 75 and the plate member 80. Thus, the header body portion 75 and the plate member 80 are temporarily assembled.

Moreover, in the first step, the gas-side connection pipe 90 is inserted into the gas-side connection-pipe insertion hole H2 of the header body portion 75, and is engaged with the edge portion of the inserted hole. Thus, the gas-side connection pipe 90 and the header body portion 75 are temporarily assembled. Furthermore, in the first step, the liquid-side connection pipe 95 is inserted into the liquid-side connection-pipe insertion hole H3 of the header body portion 75, and is engaged with the edge portion of the inserted hole. Thus, the liquid-side connection pipe 95 and the header body portion 75 are temporarily assembled.

After the first step is completed, by using a jig, a second step of properly inserting the heat transfer tubes 60 into the heat-transfer-tube insertion holes H7 of the assembled header collecting tube 70 is performed. By the second step, the header collecting tube 70 and the heat transfer tubes 60 are temporarily assembled.

After the second step is completed, a third step of assembling the heat exchange portions 50 by assembling the heat transfer tubes 60 and the heat transfer fins 68 is performed.

After the third step is completed, a fourth step of joining the parts of the assembled outdoor heat exchanger 15 by furnace brazing is performed.

After the fourth step is completed, a fifth step of deforming the heat exchange portions 50 at the third heat exchange portion 53, by bending in a round shape, into a substantially L-like shape in plan view (that is, forming the first heat exchange portion 51, the second heat exchange portion 52, and the third heat exchange portion 53 at the heat exchange portions 50).

Then, the outdoor heat exchanger 15 is placed at a predetermined position of the unit casing 40, and screwed and fixed to the unit casing 40 (for example, the bottom plate 41 and the left-side panel 44) or another member (for example, the partition plate 46) by using the plate member 80 (for example, the first plate portion 81 and the second plate portion 82).

(7) Features (7-1)

Refrigeration apparatuses including heat exchangers that each cause a refrigerant and an air flow to exchange heat have been widely used. Such refrigeration apparatuses require various countermeasures to be considered to suppress a decrease in reliability in the following viewpoints. For example, in a case where a refrigeration apparatus is installed in a coastal region, a countermeasure against salt-air damage is required to be considered. Moreover, in a case where pipes and tools made of different kinds of metal (for example, copper and aluminum or an aluminum alloy) are connected to each other in a heat exchanger, a countermeasure against galvanic corrosion is required to be considered. Furthermore, in a case where an air flow is bypassed to a header collecting tube of a heat exchanger without properly passing through a heat transfer portion of the heat exchanger, performance may be degraded, and hence the bypass is required to be stopped. In these viewpoints, in a refrigeration apparatus of related art (in particular, an outdoor unit of a refrigeration apparatus), a wind shielding plate that shields a header collecting tube or a machine chamber, in which the header collecting tube is disposed, from the air flow is disposed.

Such a heat exchanger is typically disposed in a casing. The method of fixing the heat exchanger to the casing is typically fixing by screwing via a fixing member.

That is, in a refrigeration apparatus including such a heat exchanger, when the wind shielding plate is disposed to suppress a decrease in reliability and the heat exchanger is screwed and fixed to the casing via the bracket, the cost increases due to an increase in the number of parts.

In the air conditioner 100 (the outdoor unit 10) according to one or more above-described embodiments, the plate member 80 includes the front surface 811 (corresponding to "wind shielding surface" described in the claims) that shields the machine chamber SP2 from the outdoor air flow AF. Thus, the outdoor air flow AF does not flow into the machine chamber SP2. Consequently, salt-air damage and galvanic corrosion are suppressed at the header collecting tube 70 disposed in the machine chamber SP2 and its peripheral portion. In addition, a decrease in the volume of air is suppressed in the fan chamber SP1 in which the heat exchange portions 50 are disposed. Relating to this, a decrease in performance of the air conditioner 100 is suppressed.

In addition, in the air conditioner 100, the plate member 80 is fixed to the header collecting tube 70 of the outdoor heat exchanger 15, and fixed to the unit casing 40 or the other member (the partition plate 46) disposed in the unit casing 40. Thus, the outdoor heat exchanger 15 can be fixed to the unit casing 40 or the other member (the partition plate 46) via the plate member 80. That is, the plate member 80 can function as "a fixing member" for fixing the outdoor heat exchanger 15 (that is, the plate member 80 can have both a function as "a shielding member" and a function as "the fixing member"). Consequently, "the shielding member" and "the fixing member" which have been constituted as separate members in related art can be integrated, and the number of parts can be decreased.

Thus, an increase in cost is suppressed, and a decrease in reliability is suppressed.

(7-2)

In the air conditioner 100 (the outdoor unit 10) according to one or more above-described embodiments, the header body portion 75 of the header collecting tube 70 has the opening Ha in the cross section in the transverse direction, the plate member 80 is joined to the header body portion 75 to cover the opening Ha, and hence the header body portion 75 and the plate member 80 form the header inner spaces (S1 to S4). Thus, the component of the header collecting tube 70 can be also used as "a wind shielding plate" and "a fixing member" for fixing the outdoor heat exchanger 15. Accordingly, the number of parts is particularly decreased as compared with related art, and an increase in cost is suppressed.

(7-3)

In the air conditioner 100 (the outdoor unit 10) according to one or more above-described embodiments, the front surface 811 (the wind shielding surface) of the plate member 80 extends along the longitudinal direction (the up-down direction) of the header body portion 75, and shields the area from the one end to the other end in the longitudinal direction of the header body portion 75, from the outdoor air flow AF. Thus, the header body portion 75 is shielded from the outdoor air flow AF. Consequently, the header body portion 75 is prevented from being corroded by galvanic corrosion or salt-air damage with high precision.

(7-4)

In the air conditioner 100 (the outdoor unit 10) according to one or more above-described embodiments, the header body portion 75 has "the protrusions" (the first ribs 771 and the second ribs 781), the plate member 80 has "the engagement holes" (the first rib insertion holes H4 and the second rib insertion holes H5), and "the protrusions" are engaged with "the engagement holes" in the state in which the plate member 80 and the header body portion 75 are fixed. Thus, the plate member 80 is easily fixed to the header body portion 75. That is, the efficiency of assembly is increased when the header collecting tube 70 is assembled.

(7-5)

In the air conditioner 100 (the outdoor unit 10) according to one or more above-described embodiments, the plate member 80 is joined by brazing to the header body portion 75 and is firmly fixed to the header body portion 75. Thus, the rigidity of the header collecting tube 70 is increased.

(7-6)

In the air conditioner 100 (the outdoor unit 10) according to one or more above-described embodiments, the portions (the edge portions of the second rib insertion holes H5 of the first rib insertion holes H4) of the plate member 80 that come into contact with the header body portion 75 (the header collecting tube 70) are made of a brazing alloy. Thus, the efficiency of brazing is increased when the plate member 80 and the header collecting tube 70 are joined by brazing (in particular, furnace brazing).

(7-7)

In the air conditioner 100 (the outdoor unit 10) according to one or more above-described embodiments, the heat transfer tubes 60 are flat tubes, and the plate member 80 has the heat-transfer-tube insertion holes H7 to which the heat transfer tubes 60 are inserted. Thus, the plate member 80 can function as the tube plate for supporting the flat tubes, thereby further promoting a decrease in the number of parts.

(7-8)

In the air conditioner 100 (the outdoor unit 10) according to one or more above-described embodiments, the edge portions of the heat-transfer-tube insertion holes H7 of the plate member 80 are made of a brazing alloy. Thus, the efficiency of brazing is increased when the plate member 80 and the heat transfer tubes 60 are joined by brazing (in particular, furnace brazing).

(7-9)

In the air conditioner 100 (the outdoor unit 10) according to one or more above-described embodiments, the portions (the second-plate-portion back surface 821 and the third-plate-portion back surface 831) of the plate member 80 that come into contact with the unit casing 40 or the other member (the partition plate 46) are made of a sacrificial material. Thus, the core material of the plate member 80 is protected from galvanic corrosion by the sacrificial material at the contact portion with respect to the unit casing 40 or the other member, thereby suppressing corrosion.

(7-10)

In the air conditioner 100 (the outdoor unit 10) according to one or more above-described embodiments, the header collecting tube 70 is made of aluminum or an aluminum alloy. That is, although the header collecting tube 70 is made of aluminum or an aluminum alloy that requires particular consideration on the countermeasure for salt-air damage and the countermeasure for galvanic corrosion, the body portion of the header collecting tube 70 is shielded from the outdoor air flow AF, and corrosion is suppressed.

(7-11)

In the air conditioner 100 (the outdoor unit 10) according to one or more above-described embodiments, the plate member 80 is made of aluminum or an aluminum alloy. Thus, occurrence of galvanic corrosion at the contact portion of the plate member 80 and the header body portion 75 is suppressed.

(7-12)

In the air conditioner 100 (the outdoor unit 10) according to one ore more above-described embodiments, the header collecting tube 70 is connected to the refrigerant pipes (P4, P5) made of a metal (copper) different from the material of the header collecting tube 70, and the connection portions (J1, J2) are disposed in the machine chamber SP2 that is shielded from the outdoor air flow AF. That is, even when the refrigerant pipes (P4, P5) made of a different kind of metal are connected to the header collecting tube 70, the plate member 80 shields the connection portions of the header collecting tube 70 and the refrigerant pipes from the outdoor air flow AF, and occurrence of corrosion (in particular, galvanic corrosion) is suppressed at the connection portions.

(8) Modifications

The above-described embodiments can be properly modified as described in the following modifications. Each modification may be combined with another modification unless a contradiction arises.

(8-1) Modification 1

In one or more above-described embodiments, the portions (the first rib insertion holes H4 and the second rib insertion holes H5) of the plate member 80 that come into contact with the header body portion 75 are made of a brazing alloy. In the viewpoint of increasing the efficiency of brazing between the plate member 80 and the header body portion 75, the plate member 80 may be constituted according to one or more embodiments. However, it is not limited thereto, and the portions of the plate member 80 that come into contact with the header body portion 75 are not necessarily made of a brazing alloy.

In this case, the portions of the first ribs 771 or the second ribs 781 that come into contact with the edges of the first rib insertion holes H4 or the second rib insertion holes H5 may be made of a brazing alloy to increase the efficiency of brazing.

(8-2) Modification 2

In one or more above-described embodiments, the portions (the edge portions of the heat-transfer-tube insertion holes H7) of the plate member 80 that come into contact with the heat transfer tubes 60 are made of a brazing alloy. In the viewpoint of increasing the efficiency of brazing between the heat transfer tubes 60 and the plate member 80, the plate member 80 may be constituted according to one or more embodiments. However, it is not limited thereto, and the portions of the plate member 80 that come into contact with the heat transfer tubes 60 are not necessarily made of a brazing alloy.

(8-3) Modification 3

In one or more above-described embodiments, the portions of the plate member 80 that come into contact with the unit casing 40 or the partition plate 46 are made of a sacrificial material. In the viewpoint of suppressing galvanic corrosion, the plate member 80 may be constituted according to one or more embodiments. However, the portions of the plate member 80 that come into contact with the unit casing 40 or the partition plate 46 are not necessarily made of a sacrificial material.

Moreover, the plate member 80 is not necessarily constituted of a three-layer clad material including a brazing material, a core material, and a sacrificial material. The configuration aspect may be properly changed. For example, the plate member 80 may be constituted of a clad material including only a brazing material and a core material.

(8-4) Modification 4

In one or more above-described embodiments, the heat transfer tubes 60, the heat transfer fins 68, the header body portion 75, the plate member 80, the horizontal partition plates 85, the gas-side connection pipe 90, and the liquid-side connection pipe 95 are made of aluminum or an aluminum alloy. However, the materials of the heat transfer tubes 60, the heat transfer fins 68, the header body portion 75, the plate member 80, the horizontal partition plates 85, the gas-side connection pipe 90, and the liquid-side connection pipe 95 are not limited thereto, and may be properly changed.

(8-5) Modification 5

In one or more above-described embodiments, the fourth pipe P4 and the fifth pipe P5 are copper pipes, and are connected to the gas-side connection pipe 90 and the liquid-side connection pipe 95 made of aluminum or an aluminum alloy (that is, different kinds of metal are connected). However, it is not limited thereto, and the fourth pipe P4 and the fifth pipe P5 may be made of the same material (metal) as that of the gas-side connection pipe 90 or the liquid-side connection pipe 95.

(8-6) Modification 6

In one or more above-described embodiments, the plate member 80 has a plurality of functions (specifically, mainly has functions (a) to (d)) as follows:

(a) a function as a component of the header collecting tube 70;

(b) a function as a tube plate that supports the heat transfer tubes 60;

(c) a function as a fixing member that fixes the header collecting tube 70 to the unit casing 40 or the other member; and (d) a function as a wind shielding plate that shields the machine chamber SP2 from the outdoor air flow AF.

In the viewpoint of decreasing the number of parts and suppressing an increase in the cost, the plate member 80 may have the above-described functions (a) to (d). However, the plate member 80 does not necessarily have all the functions, and part of the functions may be omitted.

For example, the above-described function (a) may be omitted for the plate member 80. Even in this case, the plate member 80 functions as "the tube plate", "the fixing member", and "the wind shielding plate", the advantageous effects described in (6-1) and so forth can be provided. In this case, the plate member 80 may be formed to have a shape and dimensions suitable for the above-described functions as (b) to (d), and may be properly disposed. For example, the plate member 80 may not have the predetermined openings (H4, H5, and H6), and may be fixed to the outer surface of the header collecting tube 70 by brazing.

In addition, for example, the above-described function (b) may be omitted. Even in this case, the plate member 80 functions as "the fixing member" and "the wind shielding plate", and the advantageous effects described in (6-1) and so forth can be provided. In this case, the plate member 80 may be formed to have a shape and dimensions suitable for the above-described function as (c) and (d), and may be properly disposed. For example, the plate member 80 may not have the heat-transfer-tube insertion holes H7.

(8-7) Modification 7

In one or more above-described embodiments, the header body portion 75 has "the protrusions" (the first ribs 771 and the second ribs 781), the plate member 80 has "the engagement holes" (the first rib insertion holes H4 and the second rib insertion holes H5) that are engaged with "the protrusions", and "the protrusions" are inserted into and engaged with "the engagement holes". Thus, the header body portion 75 and the plate member 80 are temporarily assembled.

However, it is not limited thereto, and for example, the plate member 80 may have "protrusions" (ribs corresponding to the first ribs 771 and the second ribs 781), and the header body portion 75 may have "engagement holes" (holes corresponding to the first rib insertion holes H4 and the second rib insertion holes H5) that are engaged with "the protrusions". Even in this case, advantageous effects similar to those of one or more above-described embodiments can be provided.

Moreover, the shape and configuration aspect of "the protrusions" are not necessarily be those according to one or more above-described embodiments, and can be properly modified in accordance with design specification and installation environment. For example, "the protrusion" may be a substantially L-shaped claw having a flange. Furthermore, the shape and position of "the engagement hole" may be properly selected in accordance with the configuration aspect of "the protrusion".

(8-8) Modification 8

In one or more above-described embodiments, the header body portion 75 has the twelve first ribs 771 and the twelve second ribs 781. However, the number of the first ribs 771 and the number of the second ribs 781 provided at the header body portion 75 may be properly changed. For example, the number of the first ribs 771 and the number of the second ribs 781 each may be thirteen or larger, or eleven or less. Moreover, the number of the first ribs 771 and the number of the second ribs 781 are not necessarily the same number, and may be different numbers. Furthermore, one of the first ribs 771 and the second ribs 781 may be properly omitted. In this case, one of the first rib insertion holes H4 and the second rib insertion holes H5 are also properly omitted.

(8-9) Modification 9

In one or more above-described embodiments, the header body portion 75 has "the protrusions" (the first ribs 771 and the second ribs 781), the plate member 80 has "the engagement holes" (the first rib insertion holes H4 and the second rib insertion holes H5) that are engaged with "the protrusions", and "the protrusions" are inserted into and engaged with "the engagement holes". Thus, the header body portion 75 and the plate member 80 are temporarily assembled.

In the viewpoint of facilitating temporary assembly and increasing efficiency of assembly, "the protrusions" and "the engagement holes" in one or more embodiments may be formed. However, "the protrusions" and "the engagement holes" are not necessarily provided to join the header body portion 75 and the plate member 80, and may be properly omitted. In this case, the header body portion 75 and the plate member 80 may be joined (for example, by brazing) to completely close the gap at the contact portions thereof.

(8-10) Modification 10

In one or more above-described embodiments, the parts of the outdoor heat exchanger 15 are joined by furnace brazing. However, it is not limited thereto, and the parts of the outdoor heat exchanger 15 may be joined by brazing outside a furnace (for example, local brazing by manual work). Alternatively, the parts of the outdoor heat exchanger 15 may be joined by a method other than brazing, for example, by welding.

(8-11) Modification 11

In one or more above-described embodiments, when the outdoor heat exchanger 15 is in the installed state, the heat-transfer-tube extending direction is the horizontal direction, and the heat-transfer-tube stacking direction is the vertical direction (the up-down direction). However, it is not limited thereto, and the outdoor heat exchanger 15 may be constituted and disposed so that, when the outdoor heat exchanger 15 is in the installed state, the heat-transfer-tube extending direction is the vertical direction, and the heat-transfer-tube stacking direction is the horizontal direction.

(8-12) Modification 12

In one or more above-described embodiments, the four header inner spaces (S1, S2, S3, and S4) are formed in the header collecting tube 70. However, the number and size of the header inner spaces formed in the header collecting tube 70 may be properly selected in accordance with design specification and installation environment. In this case, the horizontal partition plates 85 may be disposed in accordance with the number of header inner spaces to be formed.

(8-13) Modification 13

In one or more above-described embodiments, the horizontal partition plates 85 that are constituted as separate members different from the header body portion 75 and the plate member 80 are properly disposed to form the header inner spaces (S1 to S4) in the header collecting tube 70. However, the formation aspect of the header inner spaces is not necessarily limited thereto. For example, in one or more above-described embodiments, the horizontal partition plates 85 may be constituted integrally with the header body portion 75 or the plate member 80 to form the header inner spaces (S1 to S4) in the header collecting tube 70.

(8-14) Modification 14

In one or more above-described embodiments, the outdoor heat exchanger 15 has a substantially L-like shape in plan view. However, it is not limited thereto, and the outdoor heat exchanger 15 may be formed in another shape. For example, the outdoor heat exchanger 15 may be applied to a one-side heat exchanger having a substantially I-like shape in plan view, a three-side heat exchanger having a substantially U-like shape in plan view, or a four-side heat exchanger having a substantially rectangular shape in plan view.

(8-15) Modification 15

In one or more above-described embodiments, the present invention is applied to the outdoor heat exchanger 15. However, the present invention may be applied to another heat exchanger that causes an air flow and a refrigerant to exchange heat. For example, the present invention may be applied to the indoor heat exchanger 31.

(8-16) Modification 16

In one or more above-described embodiments, the outdoor heat exchanger 15 includes the header collecting tube 70 at the first end portion 56. However, the header collecting tube 70 may be disposed at a position other than the first end portion 56. For example, the header collecting tube 70 may be disposed at the first end portion 56, and additionally or alternatively, may be disposed at the second end portion 57. In this case, the plate member 80 may be disposed to shield the second end portion 57 from the outdoor air flow AF, and may be fixed to, for example, the right-side panel 43 or the front panel 45.

(8-17) Modification 17

In one or more above-described embodiments, the heat transfer tubes 60 are flat porous tubes having a plurality of refrigerant channels RP. However, the heat transfer tubes 60 are not necessarily the flat porous tubes, and may be flat tubes having a single refrigerant channel RP in the heat transfer tubes 60.

Moreover, the heat transfer tubes 60 are not necessarily be flat tubes having a flat cross section. For example, the heat transfer tubes 60 may be circular tubes having circular cross sections.

(8-18) Modification 18

In one or more above-described embodiments, the outdoor heat exchanger 15 is configured such that the gas-side inlet/outlet 151 is located near the upper end of the header collecting tube 70 and the liquid-side inlet/outlet 152 is located near the lower end of the header collecting tube 70. However, the outdoor heat exchanger 15 is not necessarily configured according to one or more embodiments. For example, the outdoor heat exchanger 15 may be configured such that the gas-side inlet/outlet 151 is located near the lower end of the header collecting tube 70 and the liquid-side inlet/outlet 152 is located near the upper end of the header collecting tube 70. Moreover, the gas-side inlet/outlet 151 or the liquid-side inlet/outlet 152 is not necessarily disposed at the first end portion 56, and may be disposed at the second end portion 57.

(8-19) Modification 19

In one or more above-described embodiments, the outdoor heat exchanger 15 includes the three heat exchange portions 50 (51 to 53). However, the number of the heat exchange portions 50 constituted in the outdoor heat exchanger 15 may be properly changed. For example, the outdoor heat exchanger 15 may include two or less heat exchange portions 50 or four or more exchange portions 50.

(8-20) Modification 20

In one or more above-described embodiments, the outdoor heat exchanger 15 has the six regions (A1 to A6). However, the number of the regions constituted in the outdoor heat exchanger 15 may be properly changed in accordance with design specification and installation environment. For example, the outdoor heat exchanger 15 may include five or less regions or seven or more regions.

(8-21) Modification 21

In one or more above-described embodiments, the outdoor heat exchanger 15 includes the two fold-back spaces (the second header inner space S2 and the third header inner space S3) at the first end portion 56, and the three fold-back portions 65 at the second end portion 57. However, the number of the fold-back portions of the refrigerant included in the first end portion 56 and the second end portion 57 may be properly changed in accordance with design specification and installation environment. For example, the outdoor heat exchanger 15 may include one, or three or more fold-back portions (fold-back spaces) at the first end portion 56. Moreover, the outdoor heat exchanger 15 may include two or less, or four or more fold-back portions 65 at the second end portion 57.

(8-22) Modification 22

In one or more above-described embodiments, the outdoor heat exchanger 15 includes the twelve heat transfer tubes 60 (60*a* to 60*l*). However, the number of the heat transfer tubes 60 included in the outdoor heat exchanger 15 may be properly changed in accordance with design specification and installation environment. For example, the outdoor heat exchanger 15 may include eleven or less, or thirteen or more heat transfer tubes 60.

(8-23) Modification 23

In one or more above-described embodiments, the employed outdoor unit 10 is a trunk-type outdoor unit that takes in the outdoor air flow AF from the rear-surface side and the side-surface side and blows out the air flow to the front-surface side. However, the outdoor unit 10 is not necessarily limited thereto, and another type may be employed. For example, for the outdoor unit 10, a top-blowing type outdoor unit having a suction port of the outdoor air flow AF at a side surface thereof and a blow-out port at the top surface thereof may be employed.

(8-24) Modification 24

The configuration aspect of the refrigerant circuit RC according to one or more above-described embodiments may be properly changed. Specifically, a portion of a circuit element in the refrigerant circuit RC may be replaced with another device, or if it is not required, the portion may be properly omitted. For example, the four-way switching valve 12 may be properly omitted. Moreover, the refrigerant circuit RC may include a device not illustrated in FIG. 1 (for example, a subcooling heat exchanger or a receiver) or a refrigerant channel (a circuit that bypasses a refrigerant). Furthermore, for example, in one or more above-described embodiments, a plurality of compressors 11 may be disposed in series or in parallel.

(8-25) Modification 25

In one or more above-described embodiments, the refrigerant circuit RC is constituted by connecting the single outdoor unit 10 and the single indoor unit 30 via the connection pipes (LP, GP). However, the number of outdoor units 10 and the number of indoor units 30 may be properly changed. For example, the air conditioner 100 may include a plurality of outdoor units 10 connected in series or in parallel. Moreover, the air conditioner 100 may include, for example, a plurality of indoor units 30 connected in series or in parallel.

(8-26) Modification 26

In one or more above-described embodiments, for the refrigerant that circulates through the refrigerant circuit RC, the HFC refrigerant, such as R32 or R410A, is used. However, the refrigerant that is used in the refrigerant circuit RC is not limited. For example, in the refrigerant circuit RC, a refrigerant, such as HFO1234yf or HFO1234ze (E), or a mixture refrigerant of these refrigerants may be used. Alternatively, in the refrigerant circuit RC, a HFC-based refrigerant such as R407C may be used. Still alternatively, in the refrigerant circuit RC, a refrigerant other than the HFC-based refrigerant, such as $CO_2$ or ammonia, may be used.

(8-27) Modification 27

In one or more above-described embodiments, the present invention is applied to the outdoor unit 10 of the air conditioner 100 serving as the refrigeration apparatus. However, one or more embodiments of the present invention may be applied to another refrigeration apparatus. For example, one or more embodiments of the present invention may be applied to a low-temperature-use refrigeration apparatus that is used for a freezer or refrigerator container, a warehouse, or a showcase; or another refrigeration apparatus having a refrigerant circuit and a heat exchanger, such as a hot water supply apparatus or a heat pump chiller.

(8-28) Modification 28

The configuration aspect of the outdoor unit 10 according to one or more above-described embodiments may be properly changed. For example, the outdoor unit 10 may be constituted like an outdoor unit 10A illustrated in FIG. 25. The outdoor unit 10A is described below. It is to be noted that the description is omitted for the parts common to those of the outdoor unit 10.

Figure 25:
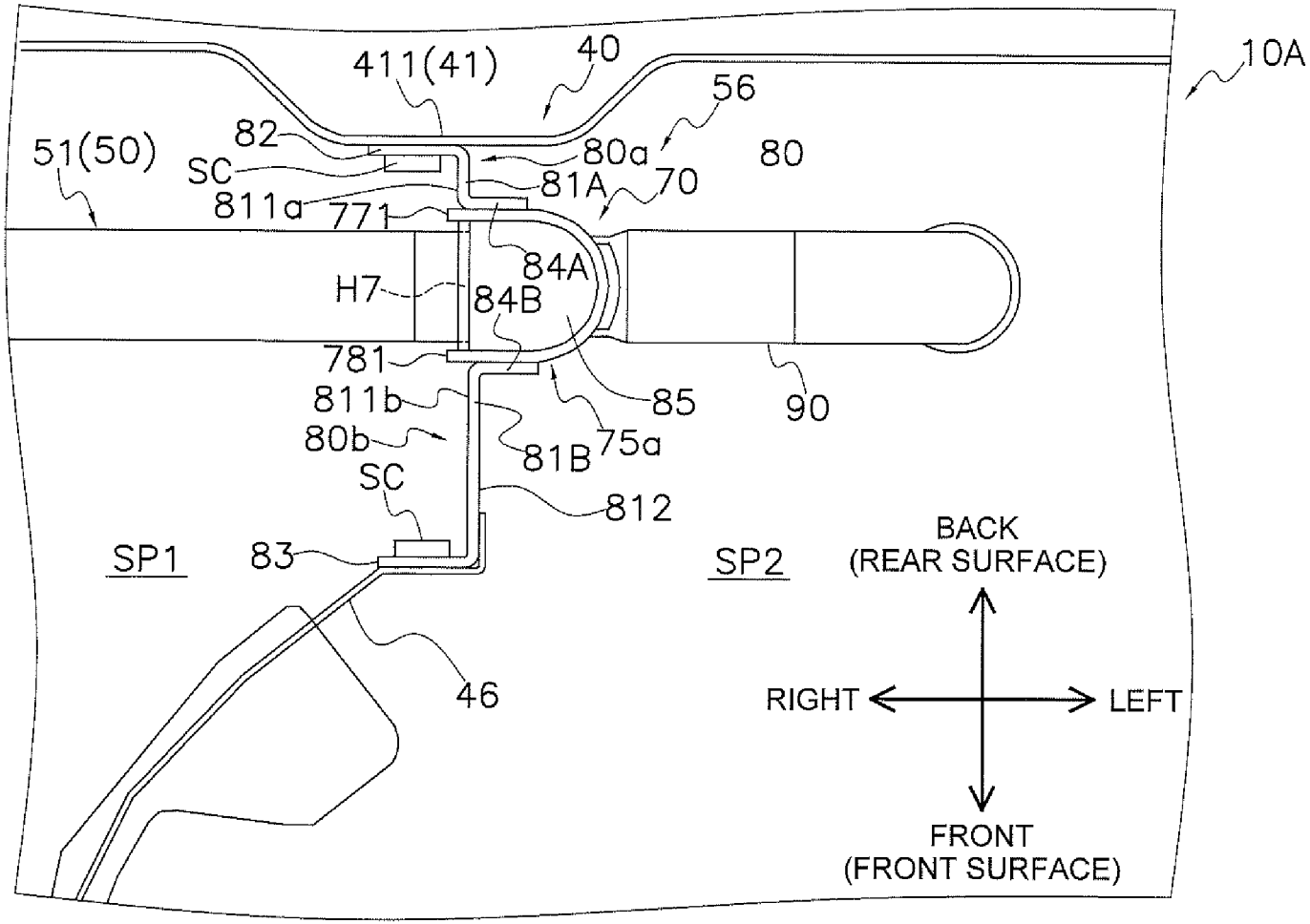
FIG. 25 illustrates an outdoor unit according to Modification 28 in the state in FIG. 11 in accordance with one or more embodiments.

FIG. 25 illustrates the outdoor unit 10A in the state in FIG. 11. In the outdoor unit 10A, the header collecting tube 70 includes a header body portion 75*a* instead of the header body portion 75. The header body portion 75*a* does not have the opening Ha unlike the header body portion 75. The header body portion 75*a* has a plurality of heat-transfer-tube insertion holes H7. One ends of the heat transfer tubes 60 are connected to the header body portion 75*a* via the heat-transfer-tube insertion holes H7.

The outdoor unit 10A includes a plate member 80A instead of the plate member 80. The plate member 80A does not function as a member that forms the header inner spaces (S1 to S4) unlike the plate member 80. In addition, the plate member 80A includes a first plate member 80*a* and a second plate member 80*b* that are separated from each other.

The first plate member 80*a* is disposed on the rear side with respect to the header body portion 75*a*. The first plate member 80*a* includes the second plate portion 82 of the plate member 80, and a portion (a rear-side first plate portion 81A) of the first plate portion 81. The rear-side first plate portion 81A corresponds to a portion of the first plate portion 81 located on the rear side with respect to the header body portion 75.

In addition, the first plate member 80*a* includes a rear-side fourth plate portion 84A. The rear-side fourth plate portion 84A extends along a direction intersecting with a direction in which the rear-side first plate portion 81A extends in plan view (in this case, the left-right direction), and is connected to an end portion of the rear-side first plate portion 81A (an end portion opposite to an end portion to which the second plate portion 82 is connected). A direction in which the rear-side fourth plate portion 84A extends from the connection portion with the rear-side first plate portion 81A is opposite to a direction in which the second plate portion 82 extends from the connection portion with the rear-side first plate portion 81A. The rear-side fourth plate portion 84A is adjacent to the rear side of the header body portion 75*a*. The rear-side fourth plate portion 84A is a portion that is joined to the header body portion 75*a* at the first plate member 80*a*. A portion of the rear-side fourth plate portion 84A that is joined to the header body portion 75*a* (a portion that comes into contact with the header body portion 75*a*) is provided with a brazing alloy.

At the first plate member 80*a*, the second plate portion 82, the rear-side first plate portion 81A, and the rear-side fourth plate portion 84A are continuously configured, and extend from the upper end to the lower end of the header body portion 75*a* in the longitudinal direction. The first plate member 80*a* thus configured has a step-like shape in plan view. The first plate member 80*a* is disposed independently from the second plate member 80*b* on the rear side with respect to the header body portion 75*a*.

The main surface of the first plate member 80*a* on the side of the fan chamber SP1 constitutes a first front surface 811*a*. The length of the first front surface 811*a* in the up-down direction (the longitudinal direction) is larger than the length of the header body portion 75*a* in the up-down direction. The first front surface 811*a* shields the machine chamber SP2 (the devices disposed in the machine chamber SP2) from the outdoor air flow AF. That is, the first front surface 811*a* corresponds to "a wind shielding surface" that shields, for example, the header body portion 75*a*, the gas-side connection pipe 90, and the liquid side connection pipe 95 from the outdoor air flow AF. The first front surface 811*a* shields the area from one end to the other end of the header body portion 75*a* in the longitudinal direction (in this case, the up-down direction), from the outdoor air flow AF.

The first plate member 80*a* including such a first front surface 811*a* serves as a wind shielding plate that is integrally formed with the header body portion 75*a*. In another viewpoint, the first plate member 80*a* includes a wind shielding plate that is fixed to the header body portion 75*a*. That is, when the first plate member 80*a* is interpreted as "a wind shielding plate" that shields the machine chamber SP2 from the outdoor air flow AF, it can be interpreted that the wind shielding plate (the first plate member 80*a*) is fixed to the header body portion 75*a*.

The second plate member 80*b* is disposed on the front side with respect to the header body portion 75*a*. The second plate member 80*b* includes a third plate portion 83 of the plate member 80, and a portion (a front-side first plate portion 81B) of the first plate portion 81. The front-side first plate portion 81B corresponds to a portion located on the front side of the first plate portion 81 with respect to the header body portion 75.

In addition, the second plate member 80*b* further includes a front-side fourth plate portion 84B. The front-side fourth plate portion 84B extends along a direction intersecting with a direction in which the front-side first plate portion 81B extends in plan view (in this case, the left-right direction), and is connected to an end portion of the front-side first plate portion 81B (an end portion opposite to an end portion to which the third plate portion 83 is connected). A direction in which the front-side fourth plate portion 84B extends from the connection portion with the front-side first plate portion 81B is opposite to a direction in which the third plate portion 83 extends from the connection portion with the front-side first plate portion 81B. The front-side fourth plate portion 84B is adjacent to the front side of the header body portion 75*a*. The front-side fourth plate portion 84B is a portion that is joined to the header body portion 75*a* at the second plate member 80*b*. That is, a portion of the front-side fourth plate portion 84B that is joined to the header body portion 75*a* (a portion that comes into contact with the header body portion 75*a*) is provided with a brazing alloy.

At the second plate member 80*b*, the third plate portion 83, the front-side first plate portion 81B, and the front-side fourth plate portion 84B are continuously configured, and extend from the upper end to the lower end of the header body portion 75*a* in the longitudinal direction. The second plate member 80*b* thus configured has a step-like shape in plan view. The second plate member 80*b* is disposed independently from the first plate member 80*a* on the front side with respect to the header body portion 75*a*, and is joined by brazing to the header body portion 75*a* at the fourth plate portion 84B.

The main surface of the second plate member 80*b* on the side of the fan chamber SP1 constitutes a second front surface 811*b*. The length of the second front surface 811*b* in the up-down direction (the longitudinal direction) is larger than the length of the header body portion 75*a* in the up-down direction. The second front surface 811*b* shields the machine chamber SP2 (the devices disposed in the machine chamber SP2) from the outdoor air flow AF. That is, the second front surface 811*b* corresponds to "a wind shielding surface" that shields, for example, the header body portion 75*a*, the gas-side connection pipe 90, and the liquid side connection pipe 95 from the outdoor air flow AF. The second front surface 811*b* shields the area from one end to the other end of the header body portion 75*a* in the longitudinal direction (in this case, the up-down direction), from the outdoor air flow AF.

The second plate member 80*b* including such a second front surface 811*b* serves as a wind shielding plate that is integrally formed with the header body portion 75*a*. In another viewpoint, the second plate member 80*b* includes a wind shielding plate that is fixed to the header body portion 75*a*. That is, when the second plate member 80*b* is interpreted as "a wind shielding plate" that shields the machine chamber SP2 from the outdoor air flow AF, it can be interpreted that the wind shielding plate (the second plate member 80*b*) is fixed to the header body portion 75*a*.

In the outdoor unit 10A, the plate member 80A does not have a function as a component of the header collecting tube 70 and a function as a tube plate that supports the heat transfer tubes 60. However, the plate member 80A has a function as a fixing member that fixes the header collecting tube 70 to the unit casing 40 or another member; and a function as a wind shielding plate that shields the machine chamber SP2 from the outdoor air flow AF, similarly to the plate member 80. Hence, in the outdoor unit 10A including the plate member 80A, the advantageous effect described in aforementioned (6-1) can be provided.

In the outdoor unit 10A, the configuration aspect, such as the shape and dimensions, of the header body portion 75*a* may be properly changed. For example, the header body portion 75*a* may have a hollow cylindrical shape having a top surface and a bottom surface.

In addition, the configuration aspect, such as the shape and dimensions, of each portion (the second plate portion 82, the rear-side first plate portion 81A, and/or the rear-side fourth plate portion 84A) of the first plate member 80*a*; and/or the configuration aspect, such as the shape and dimensions, of each portion (the third plate portion 83, the front-side first plate portion 81B, and/or the front-side fourth plate portion 84B) of the second plate member 80*b* may be properly changed in accordance with design specification and installation environment unless the function of shielding the machine chamber SP2 from the outdoor air flow AF is provided without any trouble and joint to the header body portion 75*a* is performed without any trouble. For example, the first plate member 80*a* and the second plate member 80*b* each do not necessarily have the step-like shape in plan view, and may have a substantially L-like shape or a substantially U-like shape.

One or more embodiments of the present invention can be used for a refrigeration apparatus.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10, 10A outdoor unit (refrigeration apparatus)
15 outdoor heat exchanger (heat exchanger)
18 outdoor fan
30 indoor unit
40 unit casing (casing)
40*a* suction port
40*b* blow-out port
41 bottom plate
42 top panel
43 right-side panel
44 left-side panel
45 front panel
46 partition plate
50 heat exchange portion
51 first heat exchange portion
52 second heat exchange portion
53 third heat exchange portion
55 both end portions
56 first end portion
57 second end portion
60 heat transfer tube
60*a*-60*l* first heat transfer tube to twelfth heat transfer tube
61 extension portion
65 fold-back portion
67 tube plate
68 heat transfer fin
70 header collecting tube
75, 75*a* header body portion
76 body first portion
77 body second portion
78 body third portion
80, 80A plate member (wind shielding plate)
80*a* first plate member (wind shielding plate)
80*b* second plate member (wind shielding plate)
81 first plate portion
81A rear-side first plate portion
81B front-side second plate portion
82 second plate portion
83 third plate portion
84A rear-side fourth plate portion
84B front-side fourth plate portion

85 horizontal partition plate
90 gas-side connection pipe
95 liquid-side connection pipe
100 air conditioner (refrigeration apparatus)
151 gas-side inlet/outlet
152 liquid-side inlet/outlet
411 rising portion
771 first rib (protrusion)
781 second rib (protrusion)
811 front surface (wind shielding surface)
811*a* first front surface (wind shielding surface)
811*b* second front surface (wind shielding surface)
812 back surface
821 second-plate-portion back surface
822 second-plate-portion front surface
831 third-plate-portion back surface
832 third-plate-portion front surface
A1 to A6 first region to sixth region
AF outdoor air flow (air flow)
GP gas-side connection pipe
H1 body-portion partition-plate insertion hole
H2 gas-side connection-pipe insertion hole
H3 liquid-side connection-pipe insertion hole
H4 first rib insertion hole (engagement hole)
H5 second rib insertion hole (engagement hole)
H6 partition-plate insertion hole
H7 heat-transfer-tube insertion hole (insertion hole)
Ha opening
LP liquid-side connection pipe
P1 to P6 first pipe to sixth pipe
RC refrigerant circuit
RP refrigerant channel
S1 to S4 first header inner space to fourth header inner space (header inner space)
SC screw
SP1 fan chamber (first space)
SP2 machine chamber (second space)
TH1, TH2 screw hole

The invention claimed is:

1. A refrigeration apparatus comprising:
a casing comprising a first space and a second space; and
a heat exchanger housed in the casing and comprising a heat exchange portion and a header collecting tube, wherein
the heat exchange portion:
comprises heat transfer tubes through which a refrigerant flows,
is disposed in the first space, and
causes the refrigerant to exchange heat with air flow, and
the header collecting tube comprises:
a header body portion that extends in a longitudinal direction of the header collecting tube; and
a wind shielding plate comprising a wind shielding surface that shields the second space from the air flow,
the header collecting tube is connected to the heat transfer tubes and disposed in the second space,
the wind shielding plate is:
fixed to the header collecting tube, and
fixed to the casing or a component disposed in the casing,
an interior of the header collecting tube constitutes a header inner space from which the refrigerant enters and exits the header collecting tube,
the header body portion comprises an opening in a cross section in a transverse direction perpendicular to the longitudinal direction, and
the wind shielding plate:
is joined to the header body portion to cover the opening, and
forms the header inner space together with the header body portion,
a dimension of the wind shielding plate is greater than a dimension of the header body portion in the transverse direction.

2. The refrigeration apparatus according to claim 1, wherein the wind shielding surface:
extends in the longitudinal direction, and
shields an area from a first end to a second end of the header body portion, in the longitudinal direction, from the air flow.

3. The refrigeration apparatus according to claim 1, wherein
the wind shielding plate comprises a protrusion,
the header body portion comprises an engagement hole, and
when the wind shielding plate and the header body portion are fixed, the protrusion engages with the engagement hole.

4. The refrigeration apparatus according to claim 1, wherein the wind shielding plate is joined to the header body portion using brazing.

5. The refrigeration apparatus according to claim 4, wherein a portion of the wind shielding plate that comes into contact with the header collecting tube is made of a brazing alloy.

6. The refrigeration apparatus according to claim 1, wherein
each of the heat transfer tubes is a flat tube, and
the wind shielding plate comprises an insertion hole into which each of the heat transfer tubes is inserted.

7. The refrigeration apparatus according to claim 6, wherein an edge portion of the insertion hole of the wind shielding plate is made of a brazing alloy.

8. The refrigeration apparatus according to claim 1, wherein
the wind shielding plate comprises an engagement hole,
the header body portion comprises a protrusion, and
when the wind shielding plate and the header body portion are fixed, the protrusion engages with the engagement hole.

* * * * *